US008708767B2

(12) United States Patent
Heller et al.

(10) Patent No.: US 8,708,767 B2
(45) Date of Patent: Apr. 29, 2014

(54) COLOR CHANGING TOYS, GAMES AND DEVICES

(75) Inventors: Jason Gene Heller, San Mateo, CA (US); Charles Albert, Redwood City, CA (US); Joshua William Garrett, San Francisco, CA (US); Jeff McKnight, Oakland, CA (US); Eduardo Martinez, National City, CA (US)

(73) Assignee: FunFare, LLC, Redwood City, CA (US)

( * ) Notice: Subject to any disclaimer, the term of this patent is extended or adjusted under 35 U.S.C. 154(b) by 198 days.

(21) Appl. No.: 13/220,538

(22) Filed: Aug. 29, 2011

(65) Prior Publication Data

US 2012/0052762 A1 Mar. 1, 2012

Related U.S. Application Data

(60) Provisional application No. 61/378,335, filed on Aug. 30, 2010.

(51) Int. Cl.
*A63H 33/00* (2006.01)

(52) U.S. Cl.
USPC ..... 446/147

(58) Field of Classification Search
USPC ..... 446/147
See application file for complete search history.

(56) References Cited

U.S. PATENT DOCUMENTS

| | | | | |
|---|---|---|---|---|
| 4,315,502 | A * | 2/1982 | Gorges | 600/27 |
| 4,703,572 | A * | 11/1987 | Chapin | 40/442 |
| 5,716,253 | A | 2/1998 | Aoki et al. | |
| 6,322,416 | B1 | 11/2001 | Burke | |
| 6,416,853 | B1 | 7/2002 | Nakashima et al. | |
| 6,905,431 | B2 | 6/2005 | Pearce et al. | |
| 7,044,614 | B2 | 5/2006 | Levy et al. | |
| 7,607,919 | B2 | 10/2009 | Tozuka | |
| 7,718,241 | B2 | 5/2010 | Wittmeyer, Jr. | |
| 2004/0135097 | A1 | 7/2004 | Shibahashi et al. | |
| 2007/0054590 | A1 | 3/2007 | Schmidt | |

FOREIGN PATENT DOCUMENTS

JP 2009-172021 8/2009

OTHER PUBLICATIONS

International Search Report dated Apr. 10, 2012 from International Application No. PCT/US2011/049602.
Written Opinion dated Apr. 10, 2012 from International Application No. PCT/US2011/049602.
"Strobe light water droplets," Web Page, http://www.youtube.com/watch?v=ZRINOyxWWf8 Downloaded Aug. 2011, 1 page.
"Pirates of the Caribbean: On Stranger Tides Queen Anne's Revenge Playset," Web Page, http://www.timetoplaymag.com/toys/2560/jakks-pacific/pirates-of-the-caribbean-on-stranger-tides-queen-annes-revenge-playset/ Downloaded Aug. 2011, 3 pages.
Yoon, "Description of Possible Prior Art," Aug. 2011, 1 page.

* cited by examiner

*Primary Examiner* — Michael Dennis
(74) *Attorney, Agent, or Firm* — Beyer Law Group LLP

(57) ABSTRACT

In one aspect of the present invention, a toy arrangement involving a flickering, animated and/or luminescent toy object will be described. The toy arrangement includes a toy object having an ultraviolet sensitive layer. A light source is arranged to illuminate the ultraviolet sensitive layer with ultraviolet light. The ultraviolet sensitive layer is arranged to emit colored light in response to exposure to the ultraviolet light. In some implementations, the light source is arranged to vary the intensity of the ultraviolet light, which in turn can cause the colored light emitted from the toy object to fade, brighten and flicker. The toy arrangement may also include a speaker that emits sounds that are synchronized with changes in the colored light.

16 Claims, 14 Drawing Sheets

COLOR CHANGING TOYS, GAMES AND DEVICES

CROSS-REFERENCE TO RELATED APPLICATION(S)

This application claims priority to U.S. Patent Application No. 61/378,335, entitled "Color Changing Toys and Games," filed Aug. 30, 2010, which is hereby incorporated by reference in its entirety for all purposes.

FIELD OF THE INVENTION

The present invention relates to the use of lighting in various toys, games and educational devices. Various embodiments of the present invention relate to the use of ultraviolet light to create animated sequences and visual effects to entertain and educate children.

BACKGROUND OF THE INVENTION

There are various toys and games on the market that generate a color change or glow. Some toys change color upon contact with water (e.g., U.S. Pat. No. 6,416,853 describes a diaper of a baby doll that turns yellow when exposed to water.) Another type of toy changes color when exposed to heat or cold (e.g., U.S. Pat. No. 5,716,253 involves a toy frying pan with bacon and eggs that changes color when placed over ice.) Other types of toys and games change color when physically deformed, such as a ball that can be squeezed to reveal the color of its inner core. (e.g., see U.S. Pat. No. 6,905,431.) Still another type of toy changes color using magnetic particles, as discussed in U.S. Pat. No. 7,607,919.

Although the above toys and games work well for various applications, there are ongoing efforts to make toys and games more educational and engaging for children.

SUMMARY OF THE INVENTION

In one aspect of the present invention, a toy arrangement involving a flickering, animated and/or luminescent toy object will be described. The toy arrangement includes a toy object having an ultraviolet sensitive layer. A light source is arranged to illuminate the ultraviolet sensitive layer with ultraviolet light. In various embodiments, the ultraviolet sensitive layer is (nearly) invisible in the absence of ultraviolet light and the ultraviolet light is (nearly) invisible to the human eye. The ultraviolet sensitive layer is arranged such that atoms of the ultraviolet sensitive layer become excited when exposed to the ultraviolet light. This causes the ultraviolet sensitive layer to release energy in the form of a visible colored light in response to the ultraviolet light.

In another aspect of the present invention, a method of illuminating a surface of an object to create animated effects will be described. An object (e.g., a toy, a doll, an action figure, a card, etc.) is provided that includes an ultraviolet sensitive layer on its surface. The ultraviolet sensitive layer may be generally invisible in the absence of ultraviolet light. The ultraviolet sensitive layer is then illuminated with ultraviolet light from a light source. In various implementations, the ultraviolet sensitive layer absorbs the ultraviolet light and emits a colored light in response. The intensity of the ultraviolet light is increased and decreased repeatedly. This causes the intensity of the emitted colored light to also increase and decrease (e.g., flash, flicker, fade, brighten, etc.), which can create an appearance of physical motion on the surface of the object. A sound is generated at a speaker that is synchronized with the changes in the intensity of the emitted colored light. For example, when the colored light becomes brighter, darker or flickers, the volume of the sound may correspondingly increase, decrease or become intermittent. Different sounds may be played to match changes in the colored light.

This method may be applied to a wide variety of toys, structures, games and game accessories. Various applications involve revealing a secret marking, making a simple cartoon, creating a light show or rewarding an action taken by a user with an animated sequence. In some embodiments, a feature on a toy (e.g., a headlight on a toy car, a highlight in a doll's hair, a marking on a doll's clothing, a pattern on a game card, a mouth region on a face, etc.) bursts into color when appropriately illuminated with ultraviolet light but is dim and/or invisible in its absence.

Through the use of color mixing and multiple light sources and/or layers, a wide variety of light displays can be provided. By way of example, a surface of a toy may be covered by multiple ultraviolet sensitive layers that each generate a different colored light. The colored light may be mixed with a colored light from a non-ultraviolet light source to increase the range of colors that can be created. A non-ultraviolet, colored light and the ultraviolet light can be flashed rapidly in an alternating sequence, which generates a dynamic, multi-colored light show on the surface of the toy.

Another aspect of the present invention relates to various toy arrangements that can make use of the above method. A particular implementation involves a toy arrangement that includes a tablet device and a data card. The data card has a pattern on its front surface formed from an ultraviolet sensitive layer. The tablet device includes a housing, a card slot, a viewing aperture, an interface, a light source and a speaker. The card slot is arranged to receive the data card. The viewing aperture and the card slot are arranged such that the front face of the data card is visible through the viewing aperture when the data card is inserted into the card slot. The interface is arranged to allow a user to interact with the tablet device. The light source is arranged to emit ultraviolet light and illuminate the pattern on the data card. This causes the previously invisible pattern to emit colored light and become visible.

A particular embodiment of the above toy arrangement involves a data card whose front face shows various letters of an alphabet (e.g., C, Z, R, A, B and J) and a drawing (e.g., a drawing of car.) Each letter corresponds to a button on the tablet device. When the data card is inserted into the tablet device, the speaker of the tablet device asks the user to spell the object shown in the drawing. Once the user has pressed C-A-R in the correct sequence, the previously hidden letters are revealed and parts of the drawing are illuminated with ultraviolet light. A previously unseen colored light is emitted from the drawing. A light show is performed to reward the user for choosing the correct letters. Other applications involve different data card designs that can help teach a child reading, spelling and other lessons.

Another embodiment of the present invention involves a battle card game arrangement that includes game cards and a battle card platform. Each card includes an image formed from at least one ultraviolet sensitive layer. The battle card platform includes a card engagement feature (e.g., slots) that are arranged to physically support two of the cards so that they are visible to players of the game. The battle card platform also includes a light source that is arranged to emit ultraviolet light towards one or both of the cards while they are being held in position by the battle card platform. The image on the cards is generally invisible in the absence of ultraviolet light but emits colored light and becomes visible when illuminated with the ultraviolet light.

One type of game that uses the battle card platform involves a player with a first card who wishes to attack or challenge a player with a second card. The first and second cards are inserted into the battle card platform. The player then interacts with the battle card platform (e.g., pushes a button on an interface) to initiate the attack. The battle card platform illuminates the first card with ultraviolet light to create an attack animation. By way of example, there may be a drawing of a wizard with a magic staff on the first card. When the attack is initiated, the battle card platform illuminates an ultraviolet sensitive layer on the first card that has the shape of a lightning bolt, which extends from the magic staff of the wizard. Because of the ultraviolet light, the previously invisible lightning bolt appears, flashes and emits colored light. This color display simulates the casting of lighting bolts by the wizard in battle. Furthermore, hits or damage done by each character can be tracked by illuminating other areas of a card to reveal simulated glowing wounds. The present invention contemplates using the platform with a wide variety of different games and cards.

BRIEF DESCRIPTION OF THE DRAWINGS

The invention and the advantages thereof, may best be understood by reference to the following description taken in conjunction with the accompanying drawings in which:

FIGS. 6A-6B are diagrammatic perspective view of toy arrangements involving the use of non-ultraviolet and ultraviolet lights according to a particular embodiment of the present invention.

In the drawings, like reference numerals are sometimes used to designate like structural elements. It should also be appreciated that the depictions in the figures are diagrammatic and not to scale.

DETAILED DESCRIPTION OF THE PREFERRED EMBODIMENTS

Figure 1:
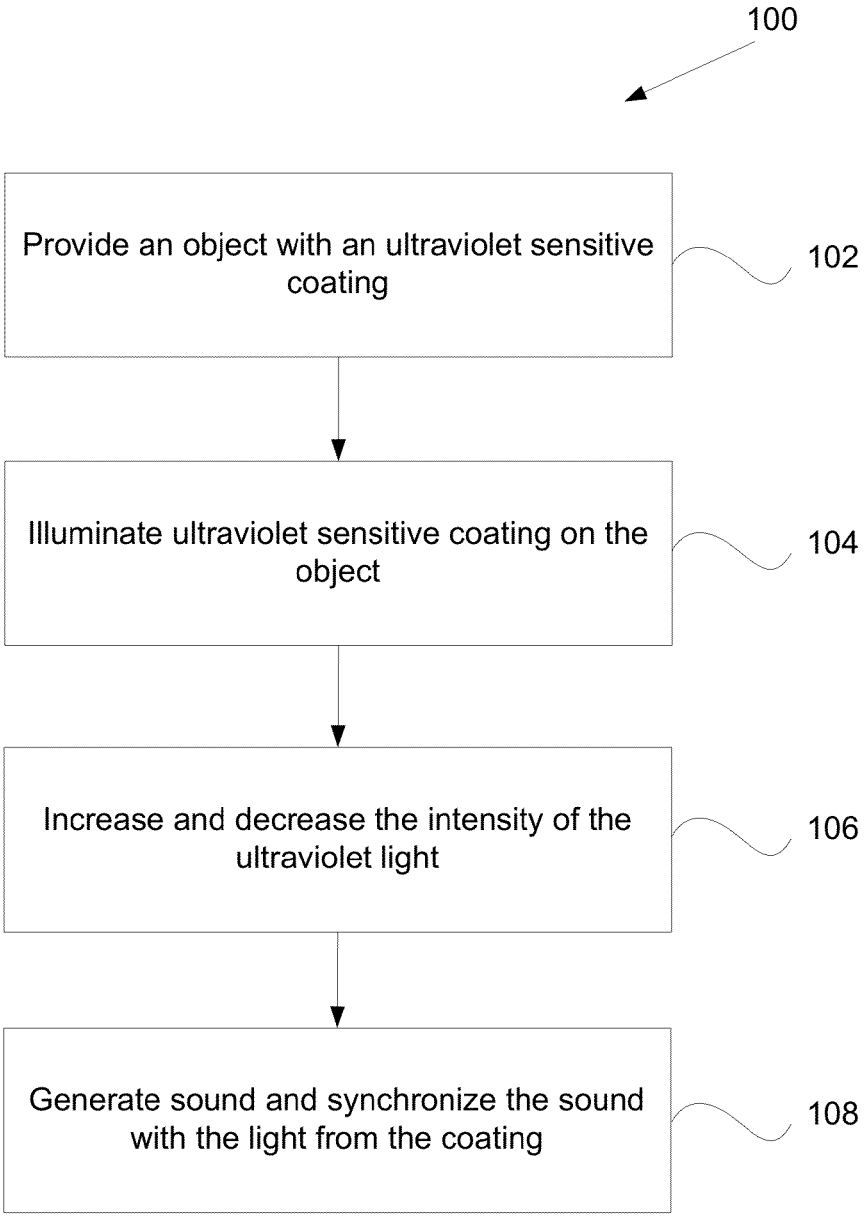
FIG. 1 is a flow chart of a method for illuminating and animating an image on a surface of an object according to a particular embodiment of the present invention.

The present invention relates generally to the use of lighting effects in toys, games and educational devices. More specifically, various embodiments of the present invention involve using ultraviolet light on a surface painted with an ultraviolet sensitive, fluorescent layer. This causes the layer to emit visible, colored light. The light emitted is not necessarily confined to just one color, but rather a full spectrum of colors constructed from the primary colors of red, green, blue, and yellow. Different techniques such as additive color mixing and optical color mixing are used to simulate even more colors. Preferably, the layer is difficult for a person to see or distinguish in the absence of ultraviolet light (e.g., the layer is not an ultraviolet sensitive layer with a highly visible color that is the same as that of its emitted light.) In various implementations, the ultraviolet light is used together with another colored light, flashed at a particular frequency or synchronized with sound to create richer, more dynamic light displays and to convey a sensation of animation and physical motion.

Ultraviolet light and ultraviolet sensitive layers have various characteristics that are well suited for toy and game applications. Ultraviolet sensitive layers can be transparent or generally invisible to the human eye before they are exposed to ultraviolet light. Ultraviolet light (e.g., black light) can also be (nearly) invisible. Hence, by painting a surface of the toy with an invisible layer and shining an invisible ultraviolet light upon it, the illusion of a self-generated luminescence or glow can be created. By manipulating the layers and lights in various ways, simple animated sequences, color change effects, and vibrant light displays can be generated. Such effects can be obtained even when the toy itself lacks an electrical system, batteries, a light bulb or a display screen.

Although the present invention contemplates a wide variety of ultraviolet sensitive and light activated layers, particularly interesting effects can be obtained through the use of fluorescent layers. Fluorescent, ultraviolet sensitive layers or paints do not merely reflect particular wavelengths of incoming light, as is the case with some other light activated paints. Instead, the high energy ultraviolet light excites atoms within the fluorescent layer. This causes the atoms to release photons that are visible in the form of a colored light. The intensity of the colored light can be controlled so that it changes in intensity or flickers at different frequencies. Additionally, the colored light can be mixed with other lights to generate dynamic, complex lighting effects. Although the glow from such layers is generally visible even in daylight, the glow is particularly striking in shaded or dark environments. Some of the toy arrangements and structure described in this patent application take advantage of this feature. Another advantage of various types of fluorescent layers is that the emission of colored light ceases or begins almost immediately after the exposure to ultraviolet light ceases or begins. In comparison to various other methods that induce color change in an object through heat, water or chemicals, this approach can allow more control and a wider variety of possible light displays and/or animations.

Figure 2:
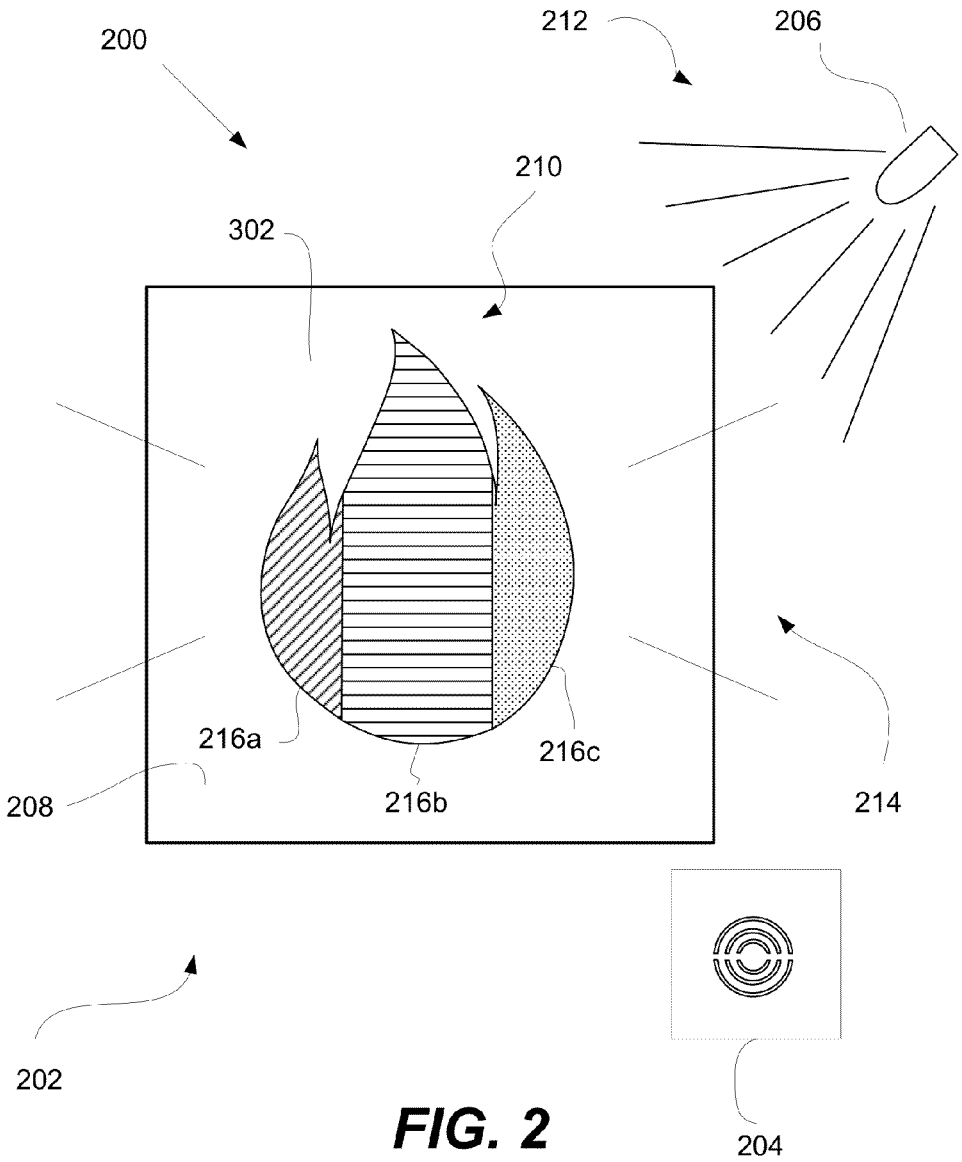
FIG. 2 is a diagrammatic view of a toy arrangement involving a surface, a light source and a flame design according to a particular embodiment of the present invention.

Referring now to FIGS. 1 and 2, an example method 100 for using ultraviolet light to create animated effects will be described. Initially, a toy arrangement 200 that includes a toy device 202, a speaker 204 and a light source 206 is provided (step 102 of FIG. 1.) A surface 208 of the toy device 202 is covered with one or more ultraviolet sensitive layers 210. The ultraviolet sensitive layer 210 is arranged to emit a colored light when exposed to ultraviolet light 212.

The ultraviolet sensitive layer 210 can be patterned and applied in any suitable manner. In the embodiment illustrated in FIG. 2, for example, the layer 210 is in the shape of a flame, but of course almost any shape is possible. Some implementations involve layers shaped in the form of a star, an insignia, a secret clue, a car headlight, a car engine, a magic spell, a discharge from a weapon, an explosion, fire, a lightning bolt, an attack action, a mouth on a face and a highlight in the hair of a doll. Layers may be applied to almost any kind of surface (e.g, rounded, flat, edged, etc.), material (e.g, plastic, metal, cloth, paper, wood, etc.) or structure (e.g., a card, a doll, a toy building, etc.) In some implementations, the layer is mixed or molded into plastic, or an object with such layers on its surface is embedded in clear or semi-transparent material.

Figure 3A:
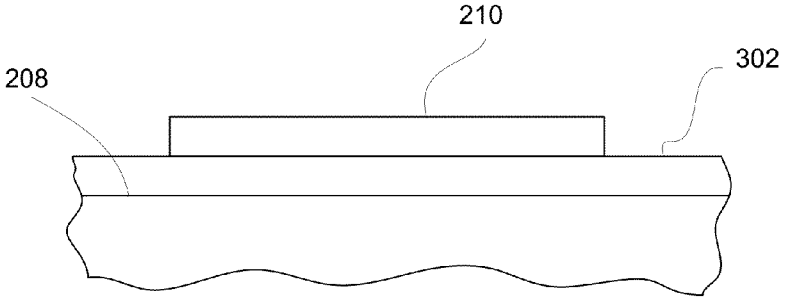
FIG. 3A is a diagrammatic side view of the surface and flame design illustrated in FIG. 2.

Generally, the ultraviolet sensitive layer 210 is invisible or barely visible until it is exposed to ultraviolet light 212. Until then, it generally appears to match the color of any paint that it overlies. FIG. 3A is a diagrammatic side view of the toy device that shows how the ultraviolet sensitive layer 210 can be layered over conventional paint 302. In the illustrated embodiment, a conventional, non-ultraviolet sensitive paint 302 covers the surface 208 of the toy device. The ultraviolet sensitive layer 210 overlies the conventional paint 302. Generally, the ultraviolet sensitive layer 210 is transparent or has the same color as the underlying conventional paint 302. Thus, in the absence of ultraviolet light, the surface 208 appears to be covered only in paint of a single color. In some implementations, a UV blocking paint (not shown) may cover portions of the surface 208 or the conventional paint 302 that are not intended to emanate colored light or respond to ultraviolet light. When struck by ultraviolet light, conventional paint can sometimes take on an undesirable hue. UV blocking paint helps eliminate this hue and can render a more pure version of its intended color.

Afterward, at step 104 of FIG. 1, the ultraviolet sensitive layer 210 is illuminated with a light source. The ultraviolet light 212 from the light source 206 is absorbed by the layer 210 and emits a colored light 214 in response. This colored light 214 may have a different color from that of the underlying conventional paint 302. In the illustrated embodiment, for example, the flame-shaped layer 210, which previously was white and therefore invisible against the underlying white paint 302, now emits the red, orange, and yellow light 214 and becomes much more visible.

Generally, the emitted colored light 214 is sufficiently strong such that it hides or obscures the color of the conventional paint 302 that underlies the ultraviolet sensitive layer 210. Thus, in the above example, a person viewing the flame shape would just see a blank whiteness prior to the use of the ultraviolet light 212, since the underlying paint 302 is white and the layer 210 is white or transparent. Once the ultraviolet light 212 is used, the person would see a red luminescent flame shape appear seemingly out of nowhere. The flame shape therefore appears to change its color.

The appearance of the emitted light 214 can be controlled by adjusting the light source 206 or by using multiple light sources (step 106 of FIG. 1.) When the ultraviolet light 212 from the light source 206 flickers at a particular speed, the emitted light 214 may flicker at the same speed. If the intensity of the ultraviolet light 212 is changed at a particular frequency, the intensity of the emitted light 214 can change at substantially the same frequency. This can be used to generate a variety of dynamic lighting effects. By way of example, in the illustrated embodiment, there are three light sources (not shown) that each direct ultraviolet light towards different, contiguous portions of the same flame shape. Each light source changes the intensity of its ultraviolet light at different frequencies, which in turn causes the intensity of the colored light from each portion to change at different rates. Thus, the middle portion 216*b* flickers at a higher rate than the left portion 216*a*, which flickers at a higher rate than the right portion 216*c*. This makes the flame appear more realistic, since a real fire does not move uniformly and flickers in a somewhat random and unpredictable manner.

Multiple light sources can be arranged in a variety of ways, depending on the needs of a particular application. As discussed earlier, each light source 206 may be arranged to direct ultraviolet light 212 towards a different region of an object and/or an ultraviolet sensitive layer. Accordingly, each region can be illuminated independently from the others. Various implementations involve light sources that arranged as a fixed, moving and/or motorized array of LEDs.

For some applications, it is also beneficial to use multiple ultraviolet sensitive layers that each emit differently colored lights. For example, in the illustrated embodiment, the middle portion 216*b* can be painted with a layer that emits a reddish color when it is exposed to ultraviolet light. The left and right portions 216*a*/216*c* can be painted with different layers that emit other colors, such as orange or yellow. To the human eye, the combination of flickering and different colors can create a more complex and realistic imitation of flame.

An interesting effect can also be achieved when the surface with the ultraviolet sensitive layer 210 is in motion. In some embodiments, a portion of or the entire toy device 202 is spun or moves along a circular path at high speed while being exposed to the ultraviolet light. The ultraviolet sensitive layer emits colored light in response to the exposure. Through a persistence of vision effect, the colored light and the motion of the object appear to form a three dimensional object.

A particular implementation of the above idea involves a ball that is painted with dots that are each formed from an ultraviolet sensitive layer. While the ball is rolling, the spinning dots on the ball are illuminated with a strobing ultraviolet light. The dots formed from the ultraviolet sensitive layer then each emit a colored light. By illuminating and rolling the ball in a particular manner, the ball can appear to be standing still or rolling in a reverse direction. This is because the eye only sees those moments when the ball is illuminated by ultraviolet light and the ultraviolet sensitive layer fluoresces.

Figure 3B:
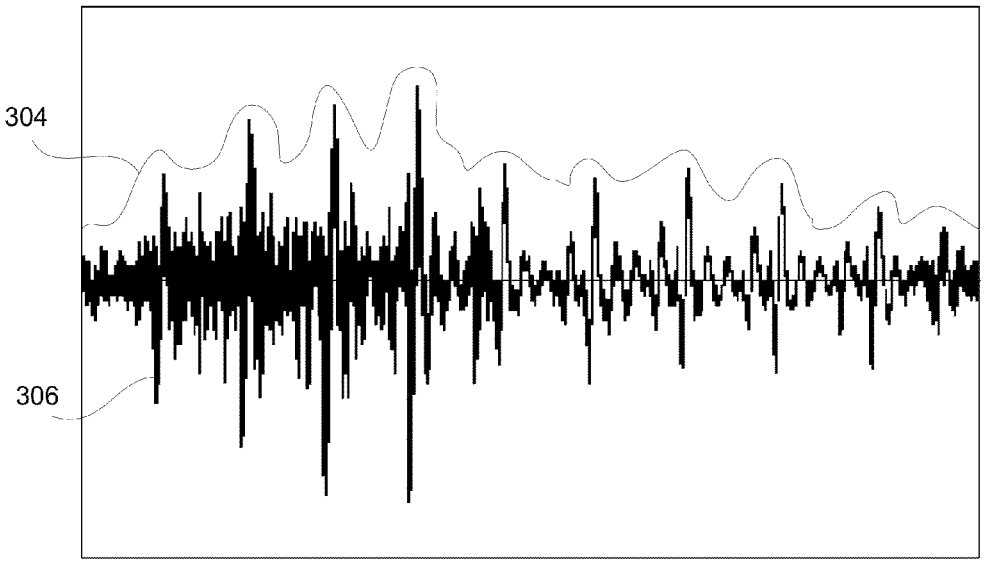
FIG. 3B is an example graph that plots the volume of a sound against the intensity of colored light according to a particular embodiment of the present invention.

The above displays can be further enhanced by synchronizing the colored light 214 with sound (step 108 of FIG. 1.) In the illustrated embodiment, for example, a speaker 204, which is coupled with the light source 206 and/or the toy device 202, generates a crackling, sizzling sound that approximates the sound of an actual fire. FIG. 3B is a simple example graph, in which curve 306 indicates the volume of the fire sound from the speaker 204 and curve 304 indicates the intensity of the colored light 214 from the layer 210. It is clear from the graph that the intensity 304 of the colored light 214 and the volume of the fire sound fluctuate in tandem with one another. That is, rises and falls in the intensity of the colored light 214 are matched by rises and falls in the volume of the sound. This also makes the flame act in a more realistic matter. Like a real fire, the crackling sound increases as the glow of the flame grows more intense but recedes when the glow of the flame gets weaker. A similar type of effect can be applied to a wide variety of patterns, structures and sounds. In a particular implementation, for example, the ultraviolet sensitive layer 210 is applied to an exposed engine of a toy vehicle (e.g., toy engine 518 of toy car 502 of FIG. 5A.) As the colored light from the engine brightens or fades (e.g., as discussed above in connection with the flame shape), the volume of a revving engine sound may correspondingly increase or decrease.

In various embodiments, when the colored light 214 emitted from the layer 210 changes in some manner (e.g., frequency of flashing, intensity, etc.), an entirely new or different sound may be generated. A particular example involves a toy car with headlights that flash in tandem with the sound of a honking horn. In this simple example, when the headlights are not illuminated with ultraviolet light (and thus do not glow), the speaker is silent or does not make the honking noise. When the headlights are illuminated with ultraviolet light (and thus glow), the speaker generates a honking noise. This kind of synchronization resembles the operation of certain types of car alarms.

It should be appreciated that the aforementioned synchronization can be modified in a wide variety of ways. For example, it is not necessarily true that a greater intensity of colored light leads to a new sound or a louder existing sound. In some applications, a greater intensity of colored light may instead be correlated with a lower volume or no sound. Generally, the intensity of the colored light is varied to help support whatever animation effect is most appropriate for the sound.

The synchronization between the sound generated by the speaker 204 and the colored light 214 emitted from the layer 210 may be achieved in various ways. For example, the speaker 204 may be coupled with and/or communicate with the light source 206 (e.g., through a wire or cable, through a wireless data connection, using infrared light, etc.) In some embodiments, an algorithm (e.g., a pulse width modulation algorithm) is used to control and synchronize changes in the volume of the speaker 204 and changes in the intensity of the ultraviolet light 212. Since the emission of colored light 214 is linked to its exposure to ultraviolet light 212, the colored light 214 is also synchronized with the volume of the speaker 204. Alternatively, the speaker 204 may be coupled with a sensor (not shown) that detects the flashing, brightening and fading of the colored light 214 from the layer 210. The speaker 204 may be arranged to adjust its volume based on the data received from the sensor.

An advantage of using special layers and ultraviolet light to produce animation and light displays is that the object emitting the colored light 214 (e.g., the object upon which an ultraviolet sensitive layer 210 is painted, such as toy device 202) does not require an electrical system, batteries, light bulbs and/or a video display. In many toys that generate light displays and animation, this is not the case. Omitting such components can drastically reduce the weight and cost associated with the light-emitting objects and allow for very small objects (even smaller than a standard LED) to emit light.

It should be appreciated that the aforementioned methods and features can be used in a wide variety of different environments, structures, toys, games and educational tools. Any of the features described in connection with the aforementioned method (e.g., characteristics of the ultraviolet sensitive layer 210, changes in the intensity of the colored light, synchronization with sound, etc.) may be applied to any embodiment described herein.

Figure 4A:
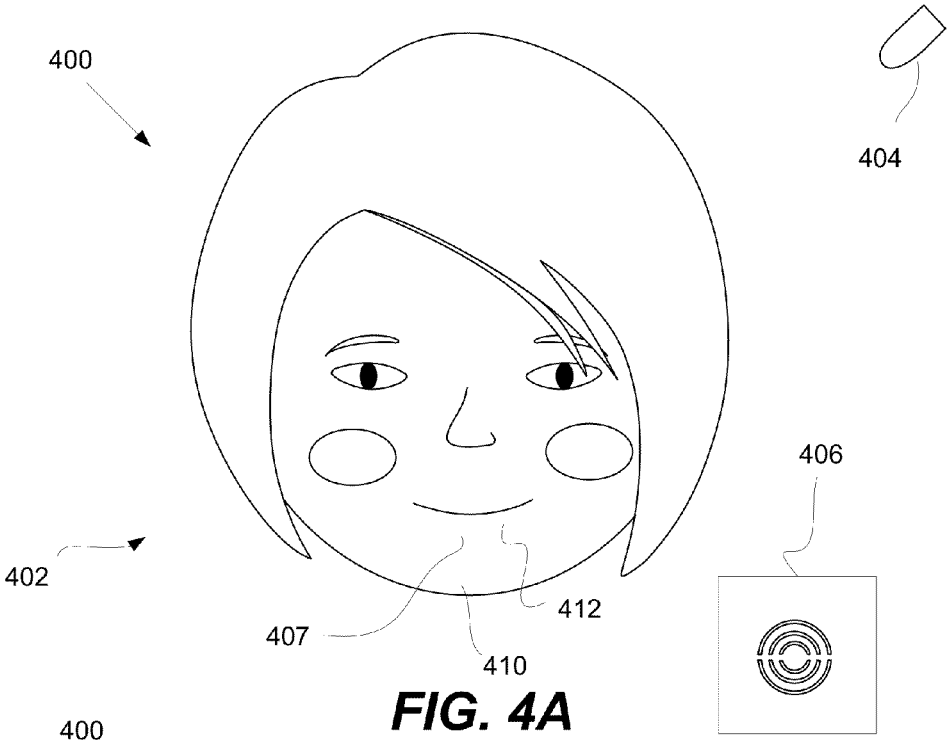
FIGS. 4A and 4B are diagrammatic views of an arrangement involving a face shape with an animated mouth region according to a particular embodiment of the present invention.
Figure 4B:
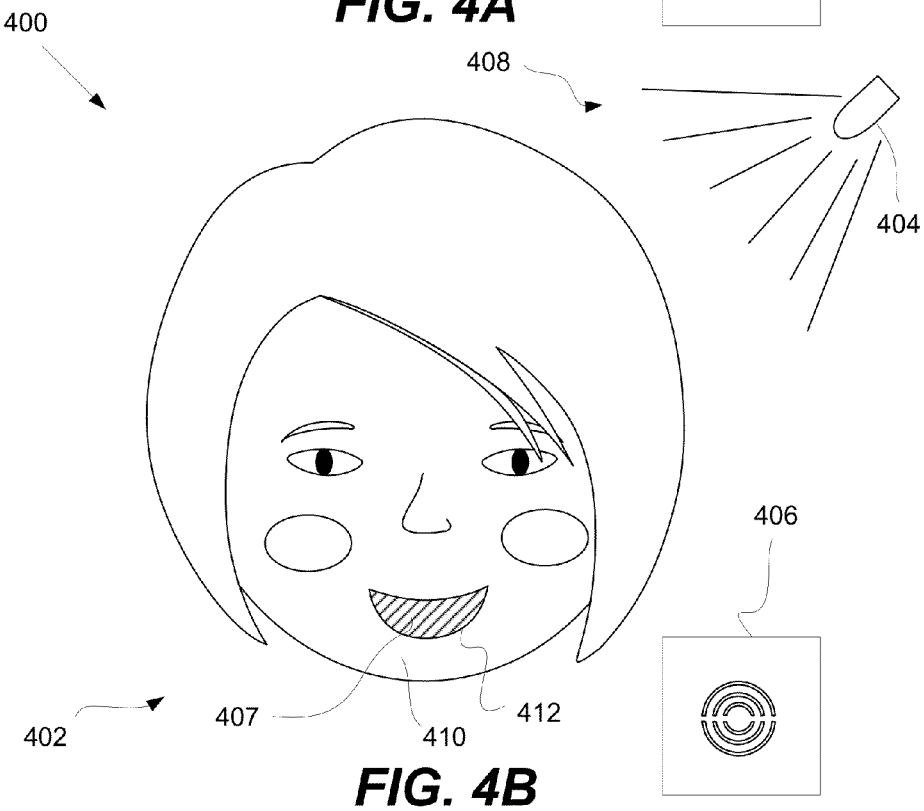

Referring next to FIGS. 4A and 4B, a toy arrangement 400 that includes a face shape 402, a light source 404 and a speaker 406 in accordance with a particular embodiment of the present invention will be described. The face shape 402 includes a mouth region 407 that is painted with an ultraviolet sensitive layer 412. When the ultraviolet light 408 from the light source 404 is switched on or off, the face shape 402 can be animated to imitate the appearance of a talking person.

FIG. 4A is a view of the face shape 402 in the absence of ultraviolet light. In this state, various facial features (e.g., mouth line, eyes, etc.) may be visible because they are painted using conventional colored paints and/or because they are defined by the shape of the toy surface. The ultraviolet sensitive layer 412 is not visible, however. Hence, the color of the mouth region 407 is generally indistinguishable from the rest of the toy surface. Because only the mouth line is visible, the face shape imitates the appearance of a person who is keeping their lips closed and who is not talking.

FIG. 4B is a view of the face shape 402 when the ultraviolet sensitive layer 412 at the mouth region 408 is exposed to ultraviolet light 408 from the light source 404. The layer 412 at the mouth region now emits colored light in response to the ultraviolet light 408. In this example, the emitted light has a color that is substantially darker than that of the toy surface 410. As a result, the face shape 402 imitates the appearance of a person who is opening their mouth.

A speaker 406, which can be coupled with the face shape 402 and/or the light source 404, generates audible speech or words that are synchronized with the simulated opening and closing of the mouth. For example, in some embodiments, when a word of a sentence is being stated, the ultraviolet light 408 is turned on and the mouth region 407 emits a colored light. During gaps between words of a sentence in which nothing is said, the ultraviolet light 408 is turned off and the mouth region 407 is invisible against the toy surface 410. This gives an impression that the mouth region 407 is moving and uttering the words.

Figure 5A:
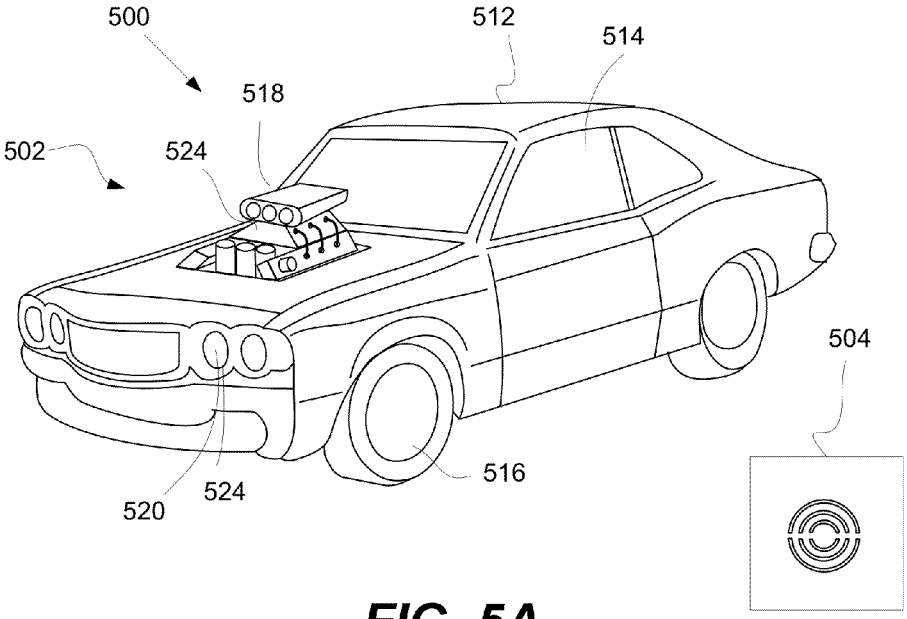
FIGS. 5A, 5B, 6A and 6B are diagrammatic perspective views of toy arrangements that involve a toy car according to various embodiments of the present invention.
Figure 5B:
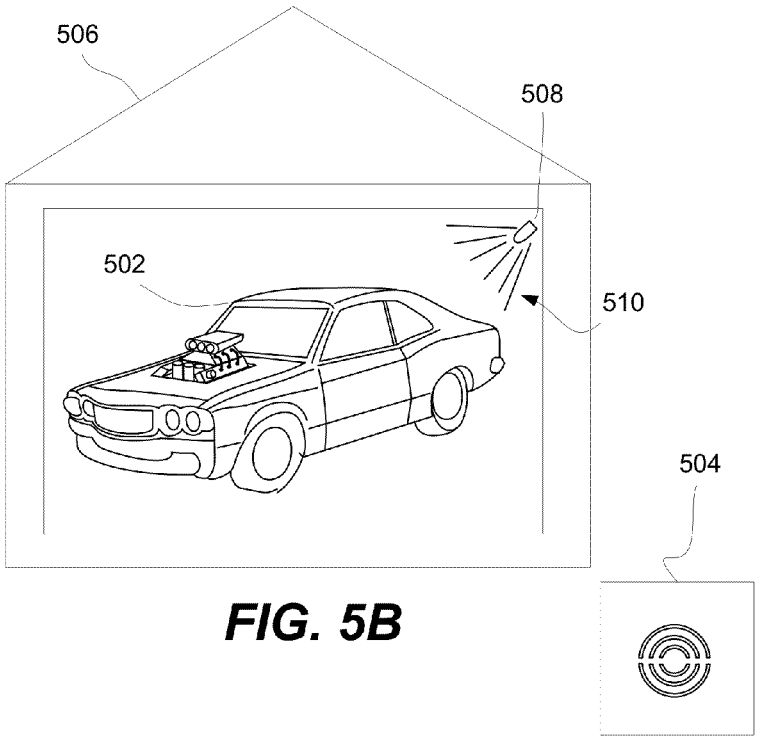

Referring next to FIGS. 5A and 5B, a toy arrangement 500 according to another embodiment of the present invention will be described. The toy arrangement includes a toy car 502, a speaker 504 and a toy structure 506 that includes a light source 508 for emitting ultraviolet light 510.

FIG. 5A is a diagrammatic perspective view of a toy car 502. The toy car 502 may have any suitable shape, composition or set of features. In this example, the toy car 502 includes a body 512, windows 514, wheels 516, an exposed front engine 518 and front headlights 520. All of these components may be painted in various colors using non-ultraviolet sensitive, conventional paints. An ultraviolet sensitive layer 524 covers the engine 518 and the headlights 520. For example, the engine 518 in this example is grey because of an application of grey paint on the engine 518, and over that paint there is also a transparent ultraviolet sensitive layer 524. (Such layering was discussed in connection with FIG. 3A.) This layer 524 is generally invisible in the absence of ultraviolet light.

FIG. 5B is a diagrammatic perspective view of the toy car 502 after it has been positioned within a toy structure 506. The toy structure 506 may resemble any kind of suitable structure, such as a garage, a house, a mountain, a tunnel, a building, a tent, etc. The toy structure 506 further includes an electrical system that powers a light source 508 for emitting ultraviolet light 510. When the toy car 502 is positioned in the toy structure 506, the ultraviolet sensitive layers 524 on the engine 518 and headlights 520 of the toy car 502 are exposed to the ultraviolet light 510 from the light source 508. As a result, colored light is emitted from the engine 518 and the headlights 520. The colored light has colors that may be different from the color of their underlying conventional paints (e.g., red for the engine, white or yellow for the headlights.) This gives an impression that the toy car 502 can self-generate light through the headlights 520 using an internal electrical system, when the toy car 502 in fact lacks any such system. Since the toy car 502 is shaded within the toy structure 506, the glow of the headlights 520 and the engine 518 are further accentuated and become particularly visible within the darkness of the interior of the toy building.

The speaker 504, which may be coupled with the toy building 506, the light source 508 and/or the toy car 502, generates engine or other suitable noises. As previously discussed, the flickering and intensity of the light emitted from the engine 518 may be synchronized with the tempo and/or volume of the sound from the speaker 504. For example, as the colored light emitted from the engine 518 gets brighter, the sound of a revving engine may grow louder. This simulates a situation in which an actual engine is being worked harder and generates correspondingly more noise. In another example, the colored light from the headlights 520 may be flashed in tandem with the intermittent beeping of a car horn. This gives the impression that the toy car 502 can self generate sound as well as light, especially since the sound is perfectly synchronized with the light.

There are various ways in which the above light and sound display can be initiated. In a particular embodiment, there is an interface coupled with the toy building. After a user places the toy car 502 in the toy building 506, the user can interact with the interface (e.g., by pressing a button, activating a switch, etc.) to cause the light source 508 to illuminate the toy car 502 and/or to cause the speaker 504 to emit synchronized sounds. In another embodiment, the activation of the light source 508 and/or the speaker automatically follows the placement of the toy car 502 in the toy building 506. For example, there may be a trigger (e.g., an optical sensor, a magnetic switch, a mechanical lever, etc.) in the toy building 506. By being placed in a particular position, the toy car 502 may be arranged to activate the trigger, which is coupled with the light source 508 and/or the speaker 504. In response to the activation of the trigger, the light source 508 and/or the speaker 504 will also activate. It is also possible to use a sensor (RFID, bar code, etc) that would uniquely identify the toy car, causing a particular sequence of sound and light to occur which is specific to that type of toy car.

Figure 6A:
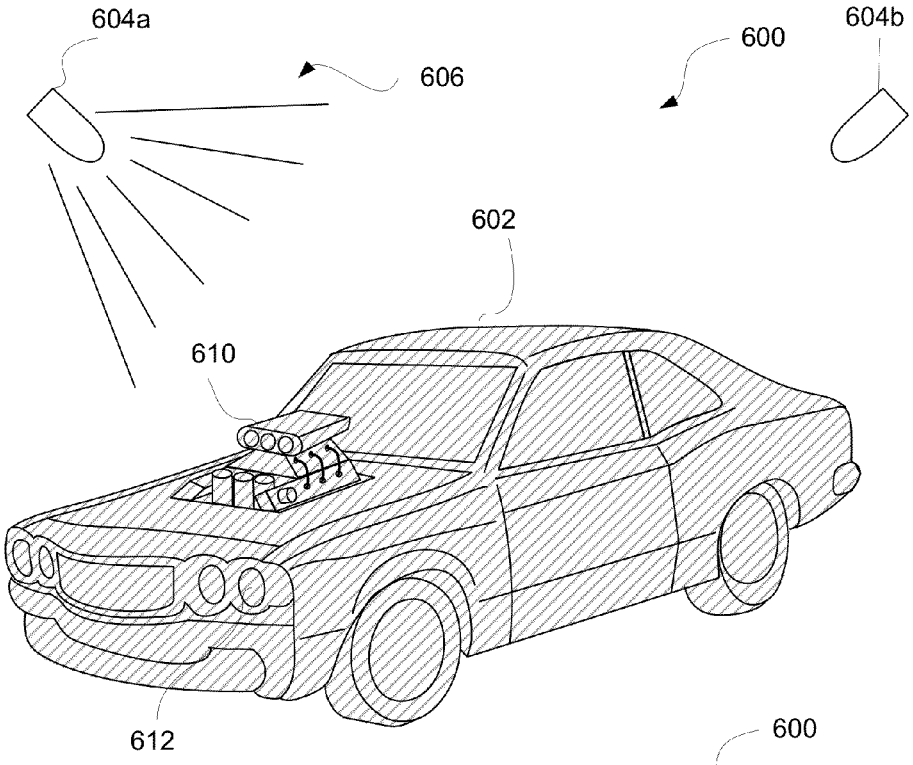
Figure 6B:
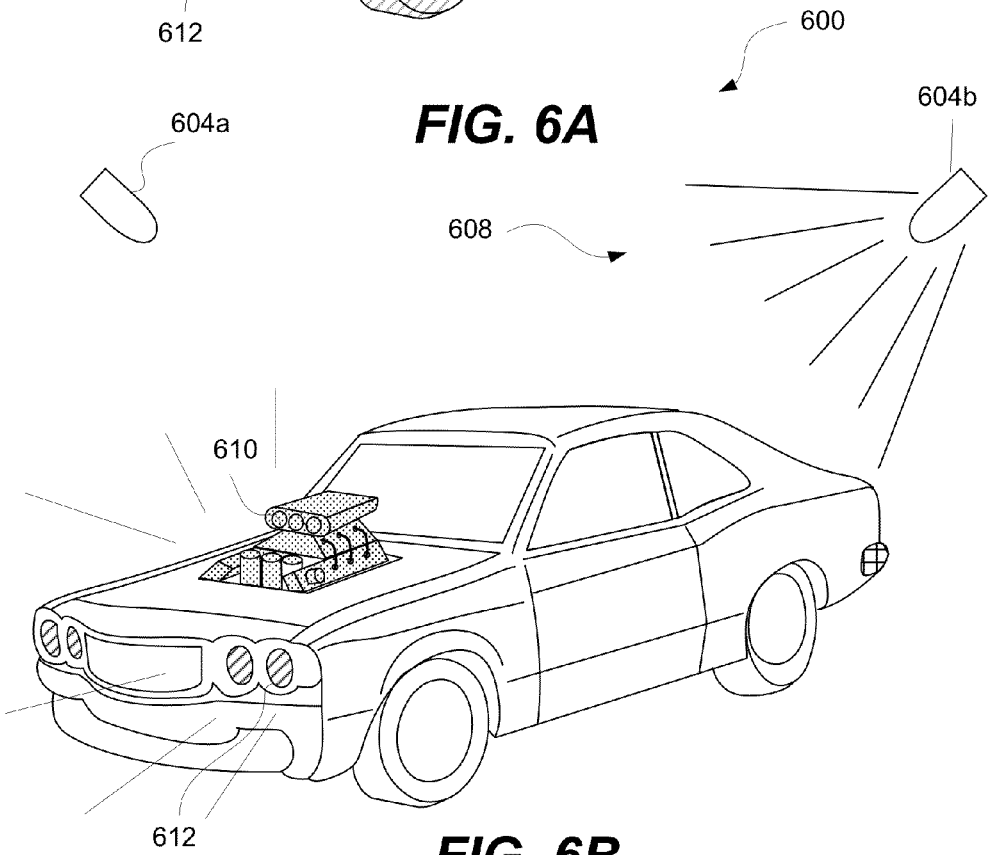

It is also possible to use standard colored lights in combination with ultraviolet lights to generate a multi-colored light display. FIGS. 6A and 6B are diagrammatic perspective views of a toy arrangement 600 involving a toy car 602 and two light sources 604*a*/604*b*. The first light source 604*a* is arranged to emit a colored, non-ultraviolet light 606. The second light source 604*b* is arranged to emit ultraviolet light 608. When these light sources alternate in emitting light towards the toy car, the toy car 602 changes colors and glows in a particularly dynamic manner.

When the toy car 602 is not exposed to light from either light source 604*a* or 604*b*, it has the color(s) of any conventional, non-ultraviolet sensitive paints that have been applied to its surface. Although ultraviolet sensitive layers have been applied to the engine 610 and headlights 612 of the toy car 602, the layers are not generally visible in the absence of ultraviolet light.

FIG. 6A is a drawing of the toy car 602 when the car is exposed to the colored light 606 from the first light source 604*a* but not from the second, ultraviolet light source 604*b*. The toy car 602 then tends to take on the color of the light 606 emitted from the first light source 604*a*. For example, if the first light source 604*a* is emitting a red-colored light, the entire toy car 602 may be bathed in a red hue. Since the colored light 606 from the first light source 604*a* is not ultraviolet, the ultraviolet sensitive layer on the engine 610 and headlights 612 are not releasing photons and light at this time.

FIG. 6B is a drawing of the toy car 602 when the toy car 602 is exposed to the ultraviolet light 608 from the second light source 604*b* while the first light source 604*a* is turned off. In this situation, the engine 610 and the headlights 612, which are painted with the ultraviolet sensitive layer, emit colored light that is the same or different from the color of any conventional paint that was also applied to those regions. The color of the emitted light may also be different from the color of the light produced by the light source 604*a*.

By moving between the three states described above (i.e., neither the first light source 604*a* nor the second light source 604*b* are turned on, only the first light source 604*a* is turned off, only the second light source 604*b* is turned on) each component of the toy car can flexibly shift between different colors and/or lighting effects. For example, the engine may have three different colors in the three states. When none of the light sources 604*a*/604*b* are turned on, the engine 610 has a color that is the same as that of the conventional paint that has been applied to it (e.g., grey.) In FIG. 6A, the engine 610 takes on a different hue that matches the color of the light generated by the first light source (e.g., red.) In FIG. 6B, the ultraviolet sensitive paint on the engine emits photons to generate a color and/or glowing effect that is not visible in the other two states (e.g., an orange glow.)

Another way to add additional colors is to mix lights to create new colors. If the first and second light sources 604*a*/604*b* are turned on at the same time, the color of the light from the first light source 604*a* can mix with the color of the light emitted from the ultraviolet sensitive layer on the engine 610 and headlights 612. Additive color mixing theory can be used to mix and generate any suitable range of light colors in this manner. For example, if the first light source 604*a* emits a blue light and the ultraviolet sensitive layer on the headlights 612 is arranged to emit a yellow light in response to ultraviolet light 608, then the resulting glow from the headlights 612 will be white.

Referring next to FIGS. 7A-7F, a tablet device 700 according to another embodiment of the present invention will be described. The tablet device 700 includes a housing 702, a card slot 704 in the housing for inserting a data card, a viewing aperture 706, a speaker 708, a light source 710 for emitting ultraviolet light, an electrical power source (e.g., one or more batteries), a processor and memory (not shown). The tablet device 700 is arranged to animate and illuminate patterns and drawings on the front face of a suitable data card using ultraviolet light. As a child interacts with the tablet device 700, the tablet device 700 can thus respond to and reward particular actions to provide an improved educational experience for the child.

Figure 7A:
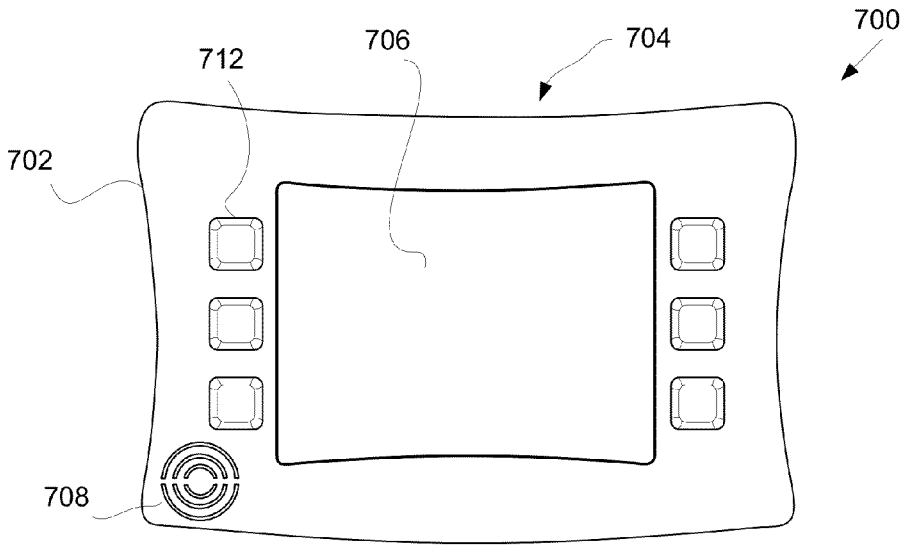
FIGS. 7A-7B are diagrammatic top and side views of a tablet device according to a particular embodiment of the present invention.
Figure 7B:
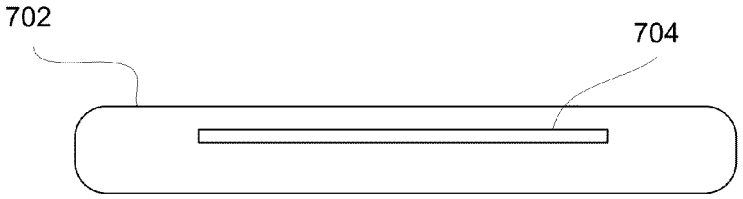

FIGS. 7A and 7B are diagrammatic top and side views of a tablet device according to a particular embodiment of the present invention. There is an interface 712 on the front surface of the tablet device 700. The interface 712 may include any number of buttons, switches, dials, etc. The front surface also includes a viewing aperture 706. A data card can be inserted into the tablet device 700 via the slot 704 in its side surface such that the front face of the data card is visible through the viewing aperture.

Figure 7C:
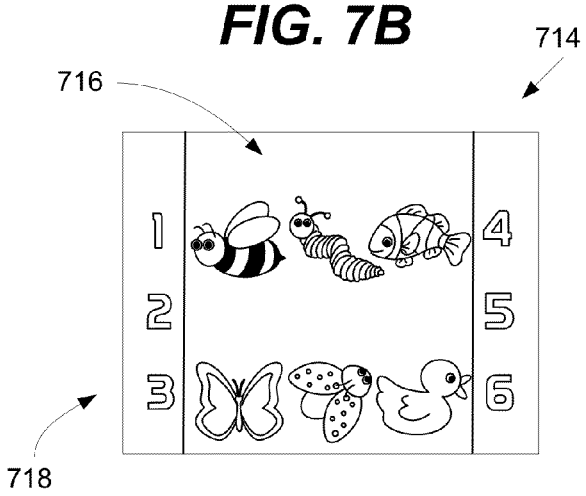
FIG. 7C is a diagrammatic top view of a data card for use in a tablet device according to a particular embodiment of the present invention.
Figure 7D:
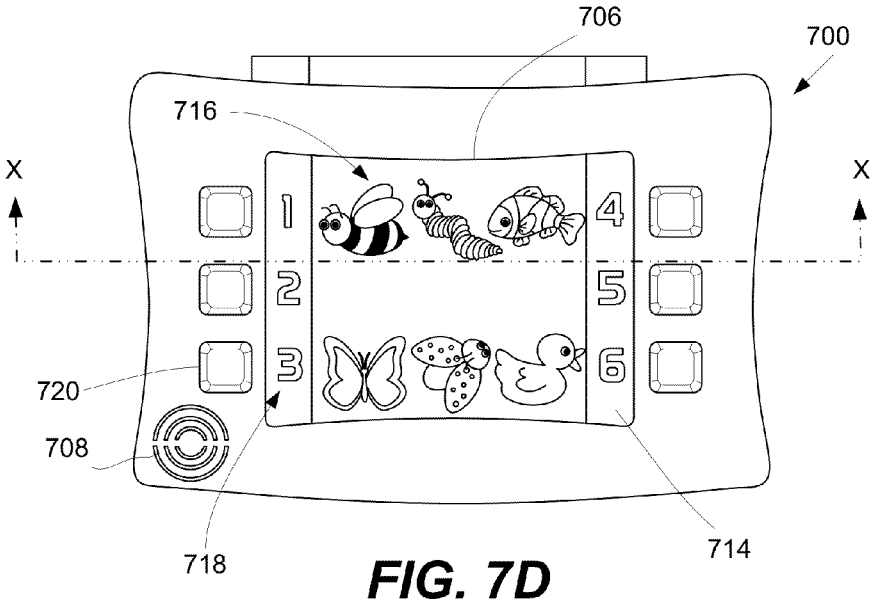
FIGS. 7D and 7F are diagrammatic top views of a tablet device with an inserted data card according to various embodiments of the present invention.

FIG. 7C is a diagrammatic top view of a data card 714, while FIG. 7D is a diagrammatic top view of the tablet device 700 when the data card 714 has been inserted into it. There are various symbols and patterns on the front face of the data card 714, such as letters, numbers, drawings, etc. In various embodiments, the data card also includes computer readable instructions that can be read by the tablet device 700. The instructions may help indicate how the tablet device 700 will respond to input from a user of the tablet device. In some embodiments, these instructions are visible in the form of a bar code on the outside of the data card 714. In another embodiment, the data card 714 includes a mechanical key that interfaces with and indicates the identity of the data card 714 to the tablet device 700.

The front face of the data card 714 may be designed in a wide variety of ways, depending on the needs of a particular application. In the illustrated embodiment, for example, the data card 714 is designed to help a child identify objects and count numbers. There are multiple items 716 drawn on the front face of the data card 714. Some of the items belong to a particular class of object (e.g., in this example, three of the items are insects) while the rest do not. There are also numbers 718 at the edges of the data card 714, which each correspond to and are aligned with a button 720 at the periphery of the viewing aperture.

In this example, the instructions on the data card 714 help the tablet device 700 to identify the data card 700 and formulate an appropriate question. Accordingly, the tablet device 700 asks the following question through the speaker: "How many insects are there?" If the child using the tablet device 700 presses the button corresponding to the correct number ("3"), then the tablet device 700 is arranged to reward this behavior by putting on a light show. In this example the animals appear in full color when illuminated by ultraviolet light, as opposed to just black and white line drawings when not illuminated. If the child fails to press the correct button, the light source(s) may help reveal a correct answer to the child, provide a hint, etc.

Figure 7E:
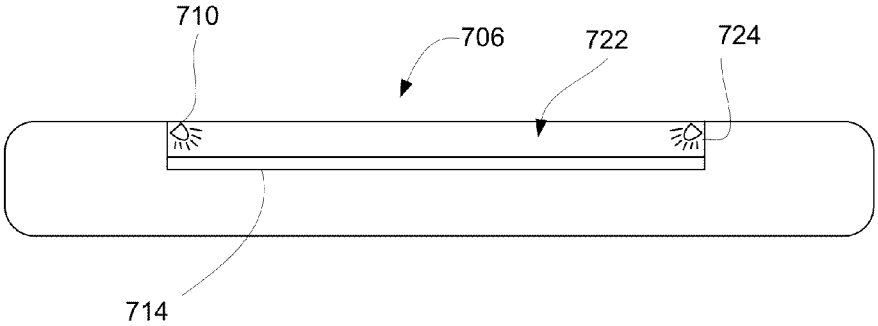
FIG. 7E is a diagrammatic cross-sectional view of the tablet device illustrated in FIG. 7D.

The positioning of the ultraviolet light source 710 in the tablet device 700 is shown in FIG. 7E. FIG. 7E is a diagrammatic cross-sectional view of the tablet device 700 illustrated in FIG. 7D, as seen along plane X. The card 714, after being inserted into the slot 704 of the tablet device 700, rests at the bottom of a recess 722 in the tablet device. One or more light sources for emitting ultraviolet light are positioned at the sidewalls 724 of the recess 722 above the data card 714. The light source 710 is arranged to emit ultraviolet light downwards toward the front face of the data card 714. As previously discussed, each light source 710 may direct light at different patterns or parts of the data card 714. As a result, different patterns (e.g., letters, drawings, etc.) may be illuminated independently from one another.

When the correct number of items is inputted by the user, the light source(s) turn on and emanate light towards portions of the front face of the data card 714 that are covered with an ultraviolet sensitive layer. As a result, these portions will glow and emit colored light. In this example, when the correct answer of three insects is inputted, each of the three insect drawings is illuminated with ultraviolet light from the light source(s) 710. The insect drawings may flash or glow in full color to indicate that a successful answer was provided. Alternatively, the insect drawings may be revealed sequentially instead of all at once. Additionally, music or sounds from the speaker 708 may be generated in tandem with the flickering of the emitted colored light. Such actions may be performed with any of the techniques and features discussed in connection with method 100 of FIG. 1. An audible message may be played from the speaker 708, telling the user that they chose correctly and did a good job.

Figure 7F:
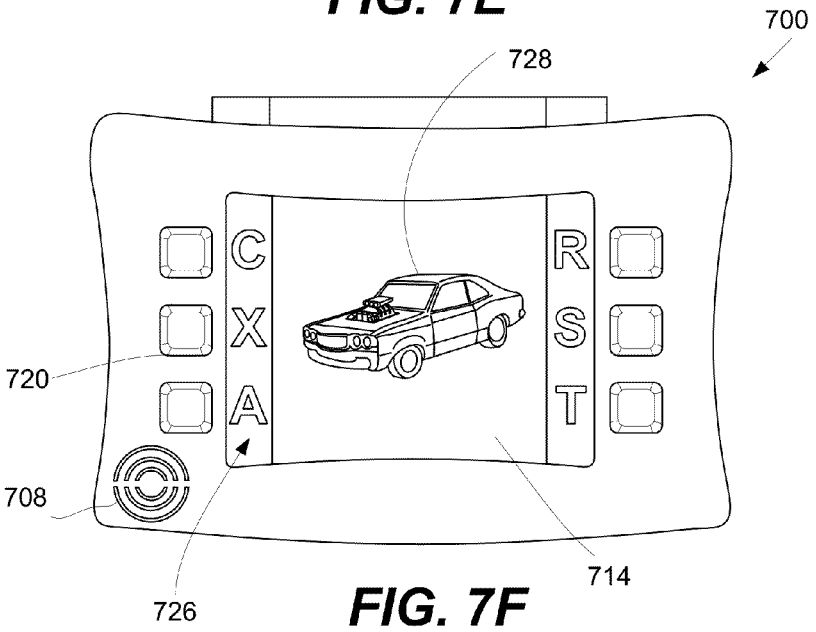

FIG. 7F is a diagrammatic top view of a different data card 714 in a tablet device 700 according to another embodiment of the present invention. This data card 714 relates to a spelling game. Instead of numbers, there are various letters 726 from an alphabet that are arranged along the edges of the data card 714. After being inserted into the tablet device 700, each of the letters will align with and correspond to a button 720 on the tablet device. There is also a drawing 728 on the data card 714.

After the data card 714 is inserted into the tablet device 700, the tablet device is arranged to read the computer readable instructions on the data card 714. The instructions will cause the speaker 708 to audibly ask the user to spell what is shown in the drawing 728. In this example, the drawing 728 is of a car. The user must press buttons 720 in the correct order to spell C-A-R. Once this takes place, the tablet device 700 will respond again by using ultraviolet light to animate a portion of the front face of the data card 714. For example, the car drawing 728 may be covered with an ultraviolet sensitive layer. When the correct spelling is inputted by a child, the layer on the car drawing 728 may flash or flicker or explode in a glow of color as it is exposed to invisible ultraviolet light from the light source 710 in the tablet device 700. In another embodiment, an ultraviolet sensitive layer is used to form the letters C, A and R, which each are illuminated independently by different light sources. As the user correctly chooses each letter in order, the corresponding letter will be illuminated one by one with ultraviolet light and appear. Successfully picking all of the letters then results in an additional light show (e.g., the illumination of the layer on the car drawing 728.) This emission of colored light may be synchronized with suitable sounds from the speaker 708 (e.g., audible speech indicating that the user chose correctly, triumphant music, car sounds such as the revving of a car engine, etc.) Any of the approaches discussed in connection with FIGS. 1, 5A-5B and 6A-6B may be used to color and animate the car drawing on the data card.

Figure 8A:
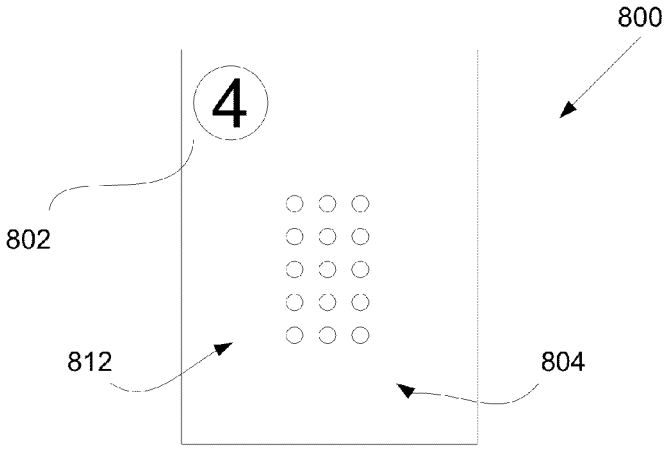
FIGS. 8A-8C are diagrammatic views of an arrangement involving game cards according to a particular embodiment of the present invention.
Figure 8B:
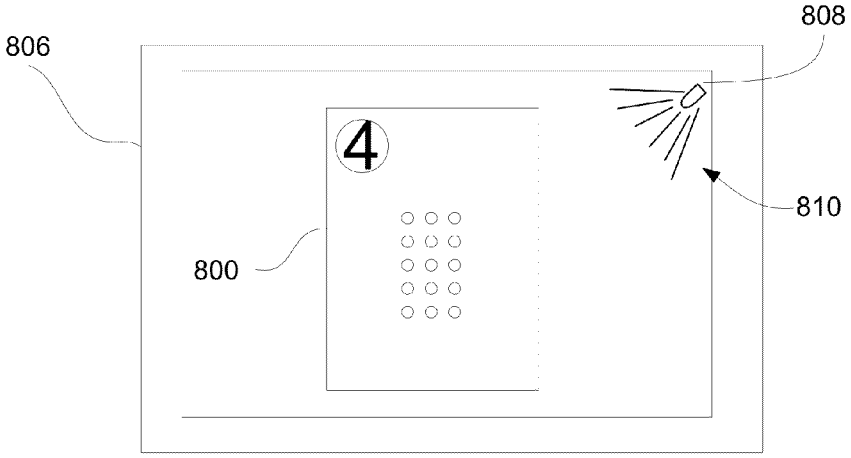
Figure 8C:
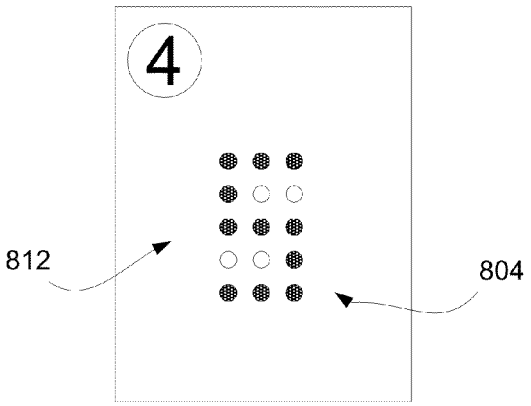

Referring next to FIGS. 8A-8C, a card 800 for use in a card game according to another embodiment of the present invention will be described. The card 800 is a thin sheet of a suitable material (e.g., paper, plastic, etc.) that includes a marking 802 that indicates how the card 800 is used during gameplay. There is also a pattern 804 on the card 800 that is formed from an ultraviolet sensitive layer. This pattern 804, which generally has a secret impact on gameplay, is revealed when the card 800 is exposed to ultraviolet light but is otherwise invisible.

An example of a card game will be described below. When the card game is played, a stack of cards are used by various players. The card illustrated in FIG. 8A is one of those cards. There are one or more other cards in the stack that, in the absence of ultraviolet light, appear seemingly identical to the card 800 in the figure. However, the patterns 804 formed by their respective ultraviolet sensitive layers may differ.

At a certain point in the card game, there is an opportunity to determine additional attributes of the card 800 that one of the players is holding. To make this determination, the player inserts the card 800 into a suitable light receptacle 806. FIG. 8B is a diagrammatic view of a light receptacle 806 according to a particular embodiment of the present invention. The light receptacle 806 is a container or structure with an opening for inserting the card 800. Inside the light receptacle 806 is a light source 808 for illuminating the card 800 with ultraviolet light 810. In some implementations, the light receptacle 806 is partially closed and/or is arranged to at least partially shade the card 800 when it is inserted into the receptacle 806.

When the card is placed in the receptacle 806, the ultraviolet light 810 from the light source 808 is emitted onto the ultraviolet sensitive layer on the card 800. This causes the pattern 804 formed by the ultraviolet sensitive layer to glow. The pattern 804 provides additional information as to how the card can be played during the card game. It should be appreciated that two cards may appear identical in the absence of the ultraviolet light 810, but have different patterns 804 when exposed to ultraviolet light. These different patterns 804 indicate that in some significant way, the two cards have a different, previously secret impact on gameplay.

The previously invisible pattern on the card can take a wide variety of forms. In the illustrated embodiment, for example, each card in the stack of cards has an array 812 of dots, dashes or marks. All of the cards in the stack have a seemingly identical array 812 of dots in the absence of ultraviolet light. The dots may be painted onto the card using a convention, non-ultraviolet sensitive ink or paint. However, some of the dots in the array are covered with an ultraviolet sensitive layer. The combination of dots that are covered in this manner may differ between different cards. When the card is exposed to the ultraviolet light 810, the covered dots glow, while the uncovered dots do not. In various embodiments, the pattern 804 of glowing dots may spell out a number or a word (e.g., the "S" on the card in FIG. 8C.)

This above concept of a card with hidden attributes can have an interesting impact on gameplay in a card game. Generally, in games where each player has their own hand, the player generally feels that they fully understand the cards that they were dealt with and their implications for the game. The above use of hidden patterns, however, adds another strategic dimension. That is, a player may know that he has a card of a particular type, but must also realize that he does not know the full value of the card until a particular point in gameplay during which the secret markings or patterns of the card can be revealed.

Figure 9A:
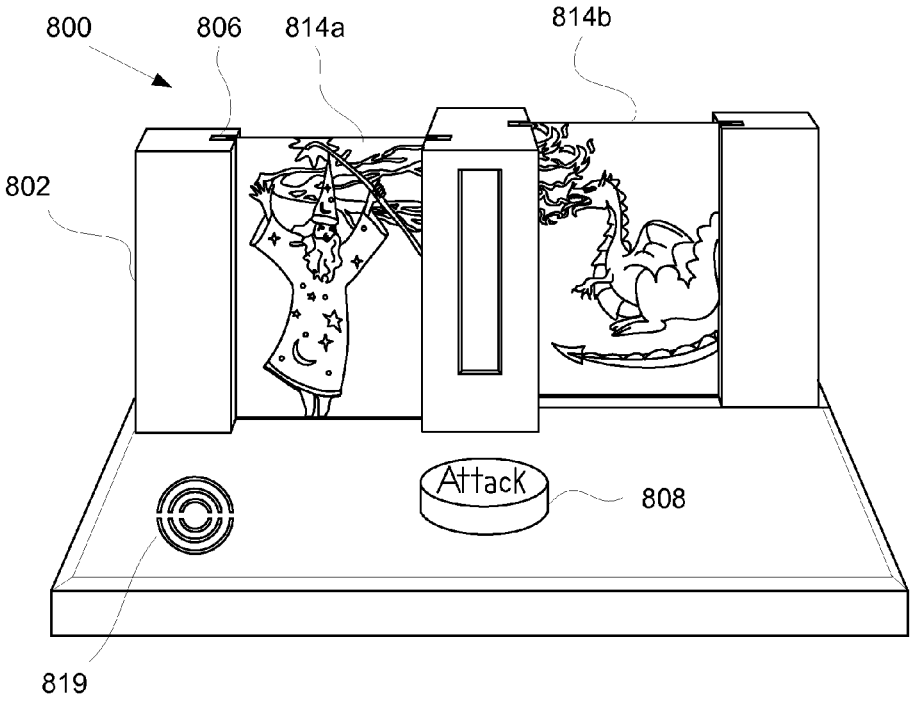
FIGS. 9A-9B are diagrammatic perspective and side views of a battle card platform according to a particular embodiment of the present invention.
Figure 9B:
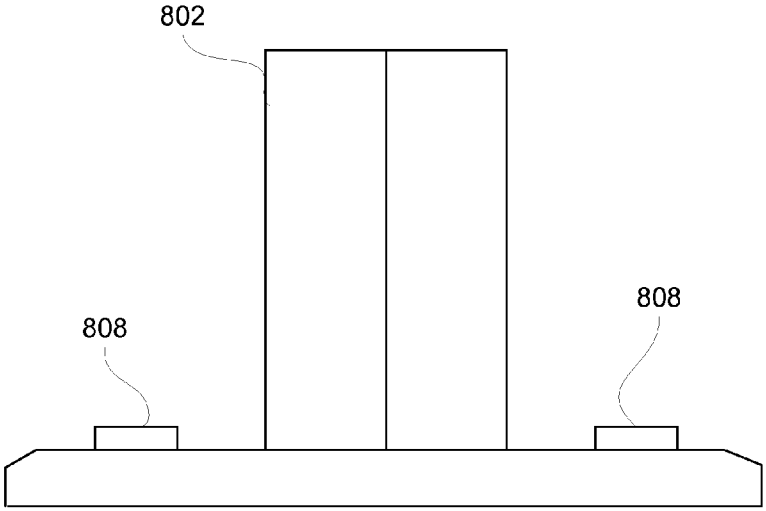

Referring next to FIGS. 9A-9B, a battle card game arrangement 800 according to a particular embodiment of the present invention will be described. The battle card game arrangement 800 includes a battle card game platform 802 that includes a light source (not shown) for emitting ultraviolet light and is arranged to hold at least two battle cards 804. The two cards 804 generally represent entities (e.g., monsters, weapons, magical spells, powers, allies, etc.) that are dueling or in conflict with one another. Generally, each of the two cards 804 is held by or represents a different player. Ultraviolet light and ultraviolet sensitive layers on the cards may be used to enhance the card battles with animation and other effects.

FIGS. 9A and 9B are perspective and side views of an example battle card game platform 802. The battle card game platform 802 may be arranged in a wide variety of ways, depending on the needs of a particular application. In this embodiment, for example, the battle card game platform 802 includes a speaker 819 and vertical slits or insertion slots 806 for holding two cards (first card 814*a* and second card 814*b*) in place. Light sources are positioned on the battle card game platform 802 and are arranged to illuminate the cards with ultraviolet light. The battle card game platform 802 may also include an electrical power source (e.g., one or more batteries) and an interface 808 (e.g., a button, switch, panel, etc.) for each player that is used to interact with the platform. In this example, a button can be pushed when a player having one of the cards wishes to initiate an attack against a player with a different card.

Figure 9C:
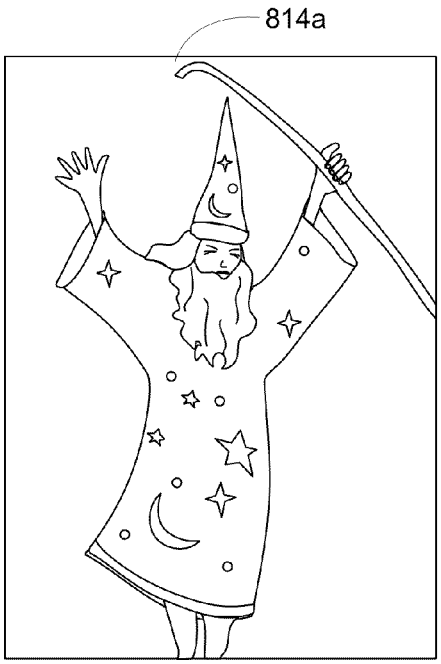
FIGS. 9C-9F are diagrammatic views of game cards according to various embodiments of the present invention.
Figure 9D:
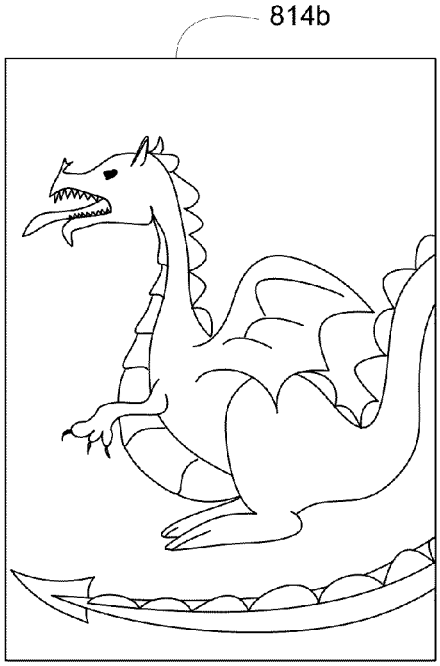

FIGS. 9C and 9D are enlarged views of the two cards. In this simple example, the first card 814*a* includes a drawing of a wizard and the second card 814*b* includes a drawing of a dragon. Of course, the battle cards 814*a*/814*b* may include any type of marking or drawing that helps indicate the significance of the card in gameplay. These designs or drawings are generally formed using conventional, non-ultraviolet-sensitive inks or paints and thus are visible in the absence of ultraviolet light. As discussed below, each card includes a pattern painted in an ultraviolet sensitive layer. However, as long as the cards are not exposed to ultraviolet light, the patterns are generally invisible to the human eye.

After the cards 814*a*/814*b* are inserted into and held in place by the battle card game platform 802, one of the players initiates an attack with the first card 814*a* against the second card 814*b*, which is held by another player. This attack may be initiated by interacting with the interface 808 (e.g., by pressing the button.) When the button is pressed, the light source illuminates at least a portion of the first card 814*a* with invisible ultraviolet light.

Figure 9E:
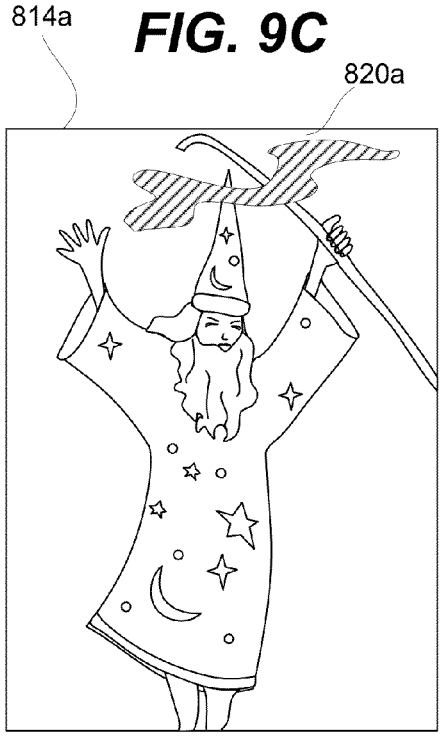
Figure 9F:
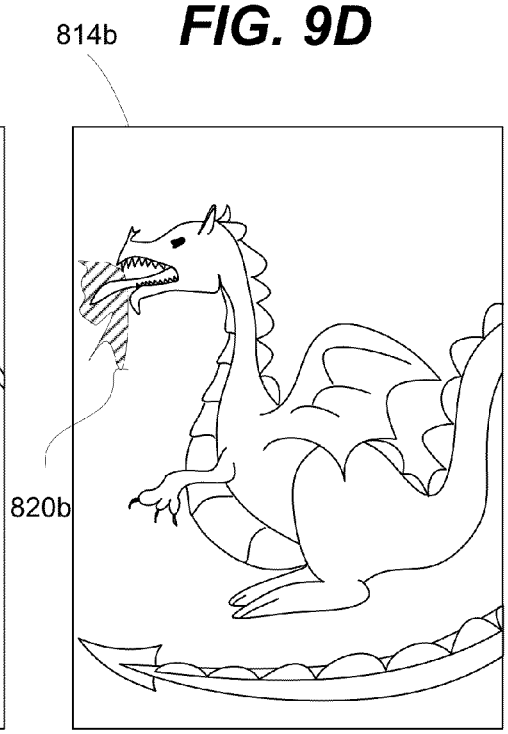

FIG. 9E shows the appearance of the first card 804*a* after it has been exposed to ultraviolet light. The ultraviolet light reveals a previously unseen, glowing pattern 820*a* in the first card. In the illustrated embodiment, the glowing pattern 820*a* is in the form of a lightning bolt that is emitted from the wizard's hand on the first card 814*a*. In some embodiments, the defending player may then counterattack by using an interface 808 (e.g., pressing a button on the other side of the battle card game platform 802.) Accordingly, invisible ultraviolet light is emitted towards the second card 804*b*, resulting in the appearance of another glowing pattern 820*b* (e.g., dragon breath from the dragon shown on the second card 814*b*.) This example effect is illustrated in shown in FIG. 9F. As discussed earlier, the colored light that is emitted from the ultraviolet sensitive layer on the cards may be made to flicker or change in intensity to make the animations more realistic and dynamic. The speaker 819 on the battle game platform may also play appropriate sounds (e.g., the crack of lighting, the rush of dragonbreath, etc.) and synchronize them with the flickering, brightening and fading of the colored light from the patterns 820*a*/820*b*.

The first and second cards 814*a*/814*b* are not limited to one type of animation or colored light, but instead may support the generation of several, different types of light displays. Different regions of the card may be covered with an ultraviolet sensitive layer and illuminated with different light sources. Thus, the different regions may emit colored light independently from one another. By way of example, the first card 814*a* may have two distinct regions that are covered with two separate and different ultraviolet sensitive layers. The battle card game platform 802 may have two light sources that are each arranged to illuminate and target a different region and layer. This allows the first card to have at least two types of patterns that may emit differently colored light at different times (e.g., a yellow lightning bolt for attacks by the wizard, a red streak to indicate that the wizard has been defeated, etc.) Additionally, the battle game platform may also include or more light sources that are arranged to emit visible, non-ultraviolet, colored light. These light sources may be used to bathe portions of or an entire card with the color of the light. Such light can be used for color mixing together with an ultraviolet light source, as discussed previously, or be used alone to indicate that a particular stage of gameplay has been reached (e.g., an entire card may be bathed in a red color to indicate that the card has been defeated.)

Figure 10A:
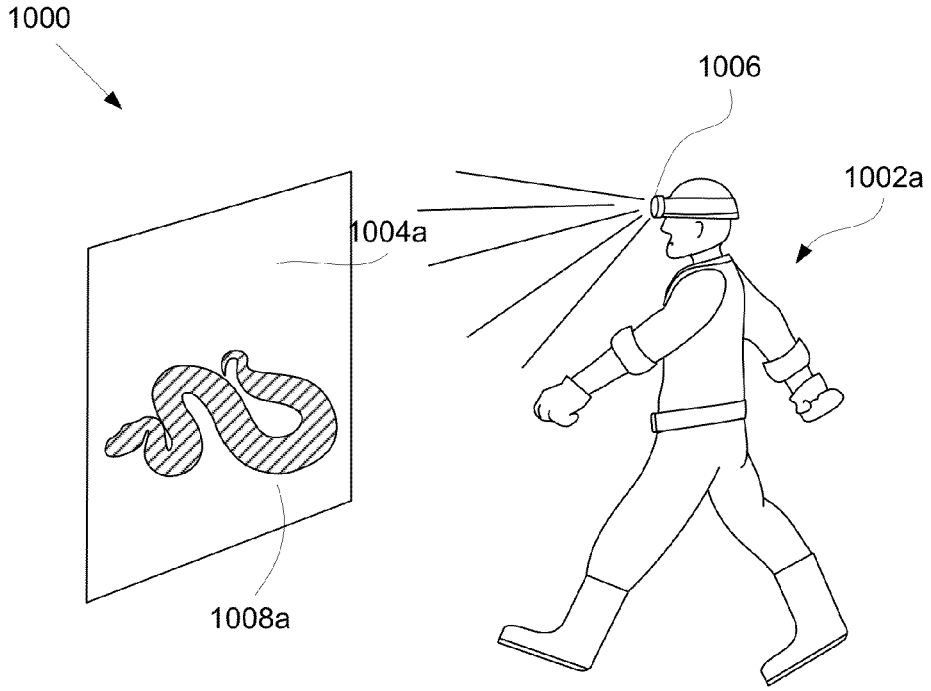
FIGS. 10A-10B are diagrammatic perspective views of toy arrangements involving a toy explorer figure and a toy magnifying glass according to various embodiments of the present invention.

Referring now to FIG. 10A, a toy arrangement 1000 according to a particular embodiment of the present invention will be described. The toy arrangement 1000 includes a toy explorer FIG. 1002*a* and a toy environment 1004*a*. The toy explorer FIG. 1002*a* has a light source 1006 on its head that is arranged to illuminate a portion of the toy environment 1004 with ultraviolet light. There is a pattern 1008*a* on a surface of the toy environment 1004*a* that is formed from an ultraviolet sensitive layer.

The toy arrangement 1000 may be used by a child who wishes to simulate examining and exploring an unfamiliar environment. The toy explorer FIG. 1002*a* may represent, for example, a soldier with infrared goggles who is searching through the darkness for clues or enemies. The light source 1006 may be positioned on or part of a pair of toy goggles, hat or headpiece that the toy explorer FIG. 1002*a* is wearing. The toy environment 1004*a* may be any structure that is arranged to imitate the physical environment around the explorer 1002*a*. It may be painted or shaped to resemble, for example, various types of terrain, foliage, building structures, rocks, mountains, water, etc.

When the light source 1006 is not turned or when the ultraviolet light is aimed such that it is not illuminating the pattern 1008*a*, the pattern 1008*a* is generally invisible. When the child positions the toy explorer FIG. 1002*a* in front of the toy environment 1004*a* such that the pattern 1008*a* is exposed to the ultraviolet light, the layer will become visible by emitting a colored light. The pattern 1008*a* and the colored light can form any type of suitable shape. In this example, the toy environment 1004*a* represents a forest and the colored light/pattern 1008*a* has the form of a dangerous snake. This simulates a situation in which an explorer discovers hidden clues or enemies in his surroundings.

Figure 10B:
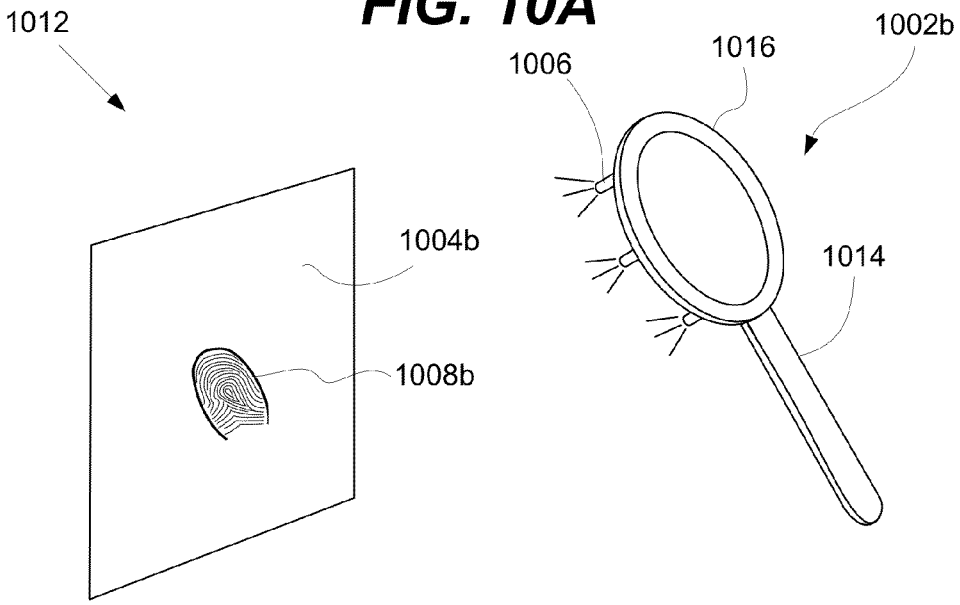

Referring now to FIG. 10B, a variation on the above toy arrangement 1000 according to another embodiment of the present invention will be described. The toy arrangement 1012 includes a toy magnifying glass 1002*b* having a handle 1014 and a viewing element 1016. The viewing element 1016 includes an aperture, possibly covered with a transparent material, and a light source 1006 suitable for emitting ultraviolet light. The toy arrangement 1012 further includes a toy environment 1004*b* that also contains a pattern 1008*b* that is painted on a surface of the toy environment 1004*b* using a ultraviolet sensitive layer. In the same manner as the toy explorer FIG. 1002*a* illustrated in FIG. 9A, when the toy magnifying glass 1002*b* is held in front of the toy environment 1004*b* such that the pattern 1008*b* on the toy environment 1004*b* is exposed to the ultraviolet light, the previously invisible pattern 1008*b* will glow and become visible. While playing the role of a detective, a child can use the magnifying glass to uncover previously secret clues (e.g., like the pattern 1008*b*, which in this example represents a fingerprint, but could represent any suitable item, including a secret code, a silhouette, a trail, a marking, etc.)

Figure 11A:
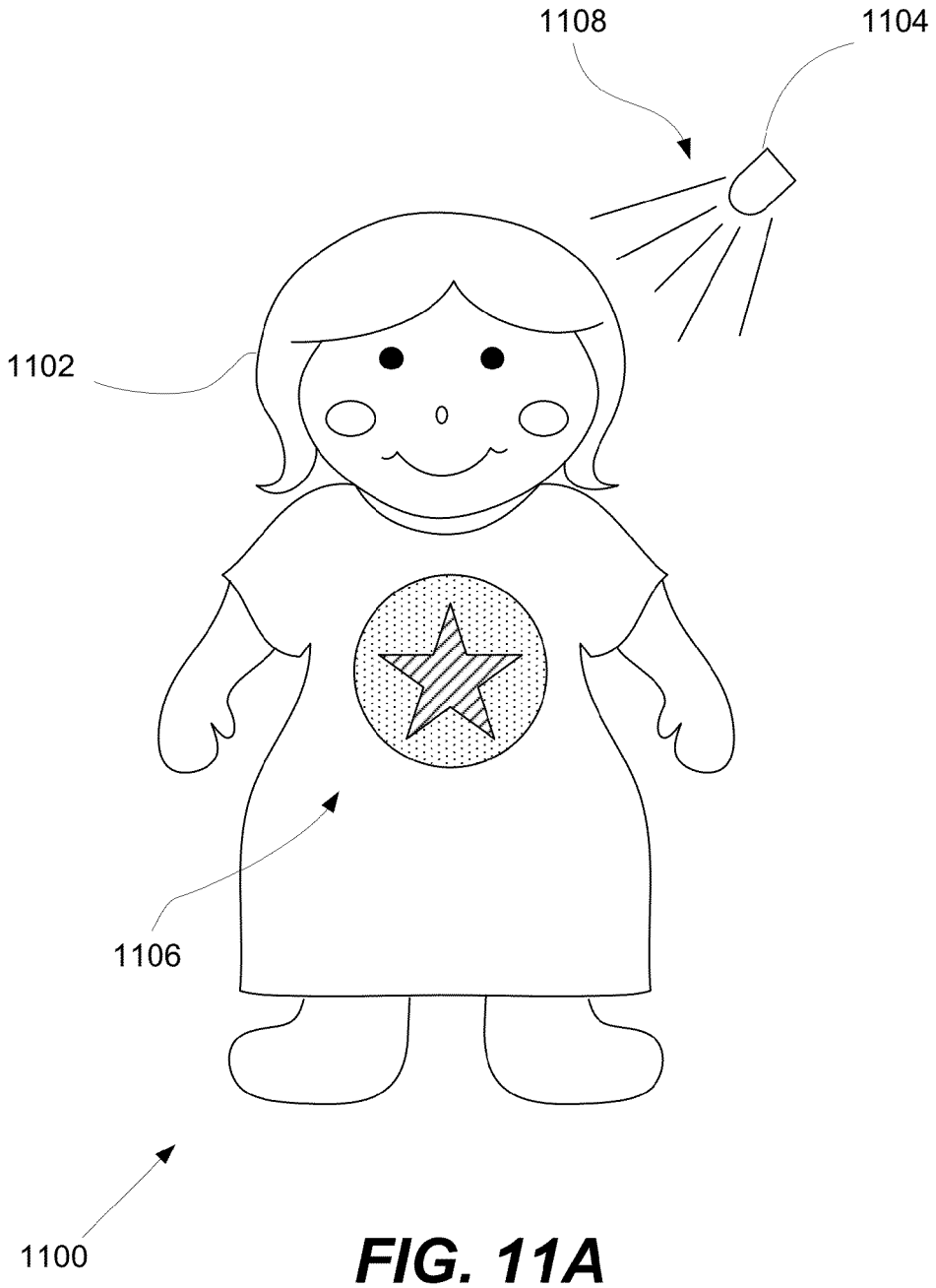
FIGS. 11A-11B are diagrammatic perspective views of toy arrangements involving dolls according to various embodiments of the present invention.

Referring next to FIG. 11A, a toy arrangement 1100 according to another embodiment of the present invention will be described. The toy arrangement 1100 includes a doll 1102 and a light source 1104 arranged to emit an ultraviolet light 1108. The light source 1104 may be coupled with the doll and/or be supported in any suitable structure (e.g., a lamp, a receptacle, etc.) The doll 1102 includes clothing with a pattern 1106 (e.g., a star on a circle) that is painted onto its surface with ultraviolet sensitive layers. The pattern 1106 is generally invisible in the absence of ultraviolet light. This can be because, for example, the clothing and the layers are the same color (e.g., if the clothing and layers are both white, one would be generally indistinguishable from the other.) Alternatively, it may be because the layers are transparent.

When the pattern 1106 is illuminated with the ultraviolet light 1108, it becomes visible by emitting one or more colored lights. In the illustrated embodiment, the pattern 1106 includes shapes that appear to be superimposed over one another i.e., the pattern 1106 is made up of a star that is entirely surrounded by a circle. The circle and star patterns are contiguous and formed from two different types of ultraviolet sensitive layers that are arranged to emit two different types of colored light. When UV light illuminates the pattern 1106, the star portion emits a yellow light and the circle emits a blue light. The intensity of these colored lights can be changed in tandem with changes in the intensity of the ultraviolet light 1108. For example, the colored lights can be made to flicker at increasing, decreasing or random frequencies. As previously discussed, these changes in intensity or frequency can be synchronized with sound from a speaker (not shown), which may be coupled with the doll 1102 and/or the light source 1104.

Figure 11B:
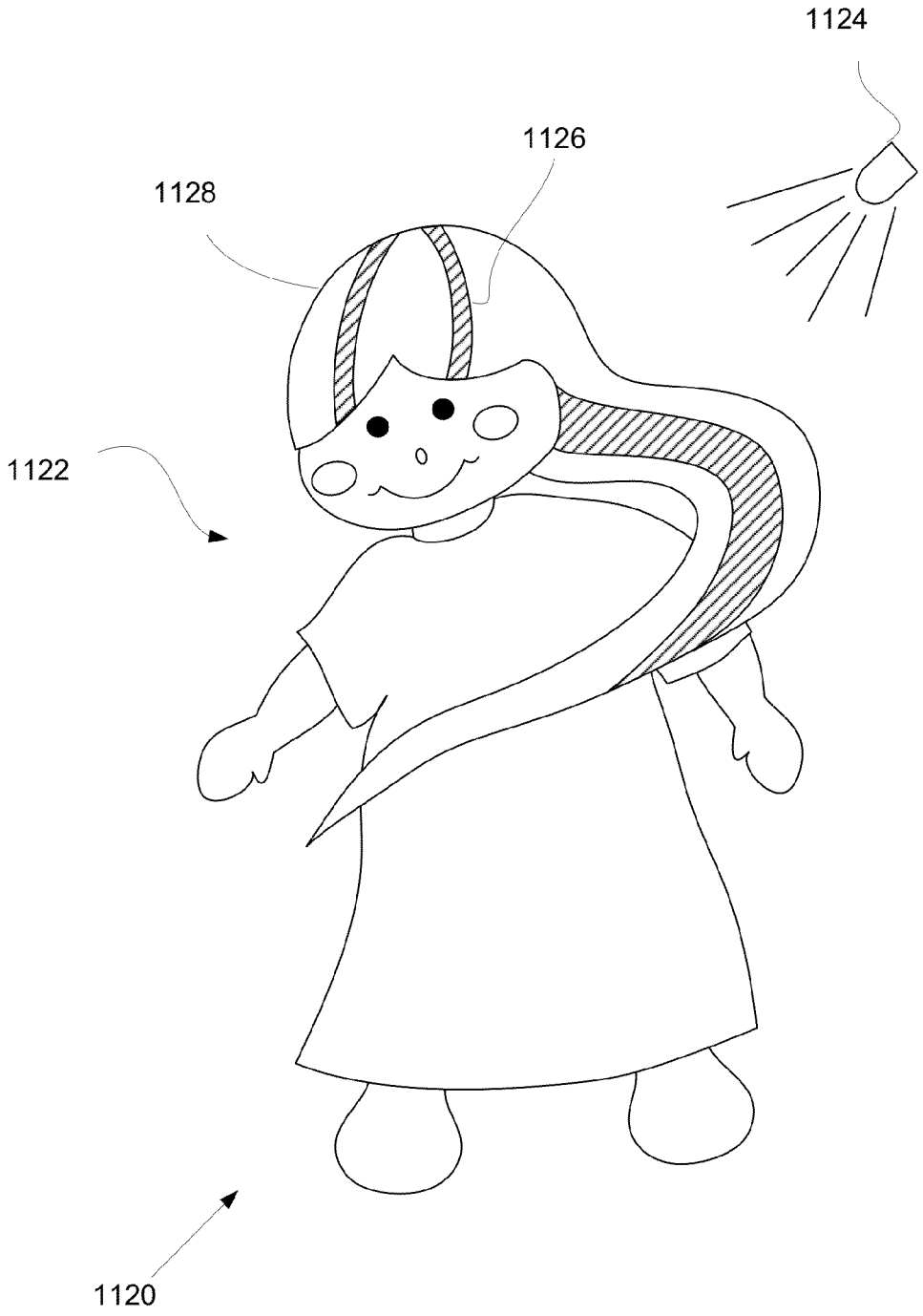

A variation on the toy arrangement 1100 illustrated in FIG. 11A is shown in FIG. 11B. The toy arrangement 1120, which also includes an ultraviolet light source 1124 and a doll 1122, functions in a similar manner as the toy arrangement 1100 illustrated in FIG. 11A. A difference is that the doll 1122 has hair 1128 with highlight regions 1126. The highlight regions 1126 are defined by and painted in an ultraviolet sensitive layer. In some implementations, these highlight regions 1126 are formed by molding or mixing the ultraviolet sensitive layer into the plastic that makes up the hair. These highlight regions 1126 behave like the pattern 1106 illustrated in FIG. 11A. That is, in the absence of ultraviolet light, the highlight regions 1126 are generally invisible to the human eye and are indistinguishable from other parts of the hair 1128. When the highlight regions 1126 are illuminated with the ultraviolet light from the light source 1124, however, they emit a selected colored light and become visible. The light source may take the shape of a "magic brush" or other toy shape.

Although only a few embodiments of the invention have been described in detail, it should be appreciated that the invention may be implemented in many other forms without departing from the spirit or scope of the invention. Although particular techniques or features may be described in connection with a particular embodiment or drawing, it should be appreciated that any technique or feature from one embodiment may be applied to any other embodiment. For example, any of the aforementioned embodiments (e.g., the face illustrated in FIG. 4A, the toy car illustrated in FIG. 5A, the data card illustrated in FIG. 7C, the game card illustrated in FIG. 8A, the game card illustrated in FIG. 9C, etc.) may involve the use of ultraviolet sensitive layers, patterns, sounds, techniques and light sources as described in connection with FIGS. 1 and 2 or any other figure. In the foregoing description, there are references to a pattern, marking or region that is invisible in the absence of ultraviolet light. However, it should be appreciated that this should not be understood as requiring total and perfect invisibility. It may mean that the layer is transparent or has a color that is highly similar to or nearly identical to the color of a conventional paint that underlies and/or surrounds the layer. In some cases, of course, close examination of such an "invisible" layer may reveal its presence even without ultraviolet light e.g., when the layer has a thickness that is small but noticeable if closely scrutinized. Additionally, the aforementioned embodiments generally are described as involving a fluorescent or light-emitting ultraviolet sensitive layer and an ultraviolet light. However, the present invention also contemplates other types of layers (e.g., photochromic) that are not necessarily fluorescent, but that change color under ultraviolet or other types of activating light. By way of example, some implementations involve ultraviolet sensitive layers or light activated layers that, instead of emitting light of a particular color, change colors through a chemical transformation of the layer in response to the activating light. In the foregoing description, there are many references to "ultraviolet light." In some embodiments, the ultraviolet light is entirely or nearly invisible to a human eye and/or is entirely or substantially entirely in the ultraviolet part of the electromagnetic spectrum. In still other embodiments, the wavelength of the ultraviolet light that is emitted by a light source is approximately between 360 and 430 nm, although various applications involve higher or lower wavelengths. The ultraviolet light is sometimes referred to herein as "invisible." This should not be understood as requiring perfect invisibility, but rather may mean almost or nearly invisible, rather than entirely invisible. Therefore, the present embodiments should be considered as illustrative and not restrictive and the invention is not limited to the details given herein, but may be modified within the scope and equivalents of the appended claims.

What is claimed is:

1. A method of illuminating a toy object with ultraviolet light to create a colorful light display, the method comprising:

providing an object having at least one ultraviolet sensitive layer that forms a pattern wherein the ultraviolet sensitive layer is transparent such that the pattern is hidden from view in the absence of ultraviolet light;

illuminating the at least one ultraviolet sensitive layer with ultraviolet light using the at least one light source, the at least one ultraviolet sensitive layer arranged to absorb the ultraviolet light and emit a colored light in response such that the previously hidden pattern is revealed, the at least one ultraviolet sensitive layer, when not exposed to the ultraviolet light, being arranged not to emit the colored light;

increasing and decreasing the intensity of the ultraviolet light repeatedly, thereby causing the intensity of the emitted colored light to also increase and decrease; and generating sound at a speaker and synchronizing the sound with changes in the intensity of the emitted colored light.

2. A method as recited in claim 1 wherein:

the ultraviolet light is generally invisible to a human eye; and the emitted colored light is not powered by an electrical system that is internal to the object.

3. A method as recited in claim 1 wherein:

the at least one ultraviolet sensitive layer includes a first ultraviolet sensitive layer and a second ultraviolet sensitive layer;

the at least one light source includes a first light source that is arranged to emit ultraviolet light at the first ultraviolet sensitive layer and a second light source that is arranged to emit ultraviolet light at the second ultraviolet sensitive layer; and the method further comprises changing the intensity of the illumination from the first light source at a first frequency and changing the intensity of the illumination from the second light source at a different second frequency such that the colored light emitted from the first ultraviolet sensitive layer flickers at a different frequency from that of the second ultraviolet sensitive layer.

4. A method as recited in claim 1 wherein:

the at least one light source includes a non-ultraviolet light source arranged to emit non-ultraviolet, visible light and an ultraviolet light source arranged to emit the ultraviolet light;

the method further comprises switching between different types of lights, which includes:

illuminating the object with the non-ultraviolet light, the non-ultraviolet light having a first color, thereby bathing the object in the first color; and after the illuminating of the object with the non-ultraviolet light, turning off the non-ultraviolet light source to cease the bathing of the object in the first color and illuminating the object with the ultraviolet light from the ultraviolet light source, which causes the colored light to be emitted from the at least one ultraviolet sensitive layer, the colored light having a second color that is different from the first color.

5. A method as recited in claim 1 wherein the object is a first card for playing in a card game, the method further comprising:

playing a card game involving a multiplicity of cards that includes the first card and a second card, the first and second cards having markings that indicate how the card is used in game play wherein the first and second cards appear generally identical when not exposed to the ultraviolet light, the first card having first pattern formed from the at least one ultraviolet sensitive layer that is different from a second pattern on the second card that is also formed from an ultraviolet sensitive layer, the first and second patterns on the first and second cards being formed from transparent ultraviolet sensitive layers such that the first and second patterns are hidden from view in the absence of ultraviolet light; and exposing the first pattern on the first card to the ultraviolet light, thereby causing the first pattern on the first card to emit the colored light, the colored light indicating a difference in how the first card and the second card can be played in the card game.

6. A method as recited in claim 1, the object being a first card for use in a battle card game, the method further comprising:

playing the battle card game in which the first card and a second card represent entities that are fighting with one another;

exposing the at least one ultraviolet sensitive layer on the first card to the ultraviolet light, thereby causing the colored light to be emitted from a first pattern that is formed from the at least one ultraviolet sensitive layer, the at least one ultraviolet sensitive layer being generally invisible to a human eye prior to exposure to the ultraviolet light; and animating an aspect of the fight between the first and second cards using the colored light from the first pattern.

7. A method as recited in claim 6 wherein the battle card game is played using a battle card game platform, the method further comprising:

inserting the first and second cards into a card engagement feature on the battle card game platform, the card engagement feature holding the first and second cards upright so that they are visible to players of the game;

illuminating the first card that is being supported by the card engagement feature with the at least one light source, which is positioned on the battle card game platform; and generating the sound at the speaker, which is positioned on the battle game card platform.

8. A method as recited in claim 1 wherein:

the at least one light source includes a first light source arranged to emit a non-ultraviolet, colored light and a second light source arranged to emit an ultraviolet light;

the first light source is arranged to emit a light of a first color and the ultraviolet sensitive layer is arranged to emit a light of a second color that is different from the first color when it is exposed to the ultraviolet light;

illuminating the at least one ultraviolet sensitive layer with lights from both the first and second light sources; and mixing the first and second colors from the first light source and the at least one ultraviolet sensitive layer to generate a light of a third color that is different from both the first and second colors, thereby causing the first ultraviolet sensitive layer to emit a glow having the third color.

9. A method as recited in claim 1 wherein the object is moving rapidly such that the colored light emitted from the at least one ultraviolet sensitive layer on the object causes a persistence of vision effect, thereby creating an illusion of one selected from the group consisting of a three dimensional object and a two dimensional object with a shape that is different from said object.

10. A method as recited in claim 1 wherein:

the object is in motion in a first direction; and the method further comprising:

turning on and off the ultraviolet light in rapid succession such that the colored light emitted from the at least one ultraviolet sensitive layer causes an illusion of movement; and varying the frequency of the turning on and off of the ultraviolet light to create an illusion of movement of the object in a second direction that is different from the first direction.

11. A method as recited in claim 1 wherein the object is a card having a drawing and a plurality of characters from an alphabet on a front face of the card and wherein the method further comprises:

receiving input from a user at a device;

based on the input, determining at the device whether the user chose some of the characters in a correct sequence to spell a particular word that describes the drawing on the card; and when the correct sequence has been inputted into the device, illuminating the at least one ultraviolet sensitive layer on the card with the ultraviolet light, thereby causing the previously hidden pattern to become visible.

12. A method as recited in claim 1 wherein the object is a card, the at least one ultraviolet sensitive layer forming a pattern on the card, there being a plurality of numbers and a plurality of items visible on a front face of the card, at least some but not all of the items belonging to a particular class of object and wherein the method further comprises:

receiving input from a user at a device;

determining at the device whether the input indicates that the user correctly chose one of the numbers that represents how many of the items belong to the particular class of object; and when the correct one of the numbers has been inputted into the device, illuminating the pattern on the card with the ultraviolet light, thereby causing the previously hidden pattern to become visible.

13. A method as recited in claim 1 wherein the object is a card, the method further comprising:

receiving the card at a viewing device such that a surface of the card forms a bottom of a recessed region in the device and is viewable through a viewing aperture on the device;

positioning the at least one light source on the device such that the at least one light source is arranged to direct the ultraviolet light onto the surface of the card;

receiving input from a user at the device; and in response to the input, activating the at least one light source to direct ultraviolet light towards the ultraviolet sensitive layer on the surface of the card, thereby revealing the previously hidden pattern.

14. A method as recited in claim 13 wherein:

the at least one light source includes a first light source and a second light source that are positioned in different locations on the device and are arranged to illuminate different locations on the surface of the card;

receiving input from the user at the device; and selectively activating the first light source or the second light source depending on the user input wherein the first and second light sources are arranged to reveal different patterns on the card using ultraviolet light.

15. A method as recited in claim 3 wherein:

the first and second ultraviolet sensitive layers are on a single surface of the object and are positioned adjacent to one another.

16. A method of illuminating a toy object with ultraviolet light to create a colorful light display, the method comprising:

providing an object having at least one ultraviolet sensitive layer wherein there is a pattern painted on the object in the shape of a face, the face including a mouth region that is covered with the at least one ultraviolet sensitive layer; and illuminating the at least one ultraviolet sensitive layer with ultraviolet light using at least one light source, the at least one ultraviolet sensitive layer arranged to absorb the ultraviolet light and emit a colored light in response, the at least one ultraviolet sensitive layer, when not exposed to the ultraviolet light, being arranged not to emit the colored light;

increasing and decreasing the intensity of the ultraviolet light repeatedly, thereby causing the intensity of the emitted colored light to also increase and decrease to create an appearance of motion on the surface of the toy object;

generating sound at a speaker and synchronizing the sound with changes in the intensity of the emitted colored light;

illuminating the mouth region with the ultraviolet light, thereby causing the mouth region to glow with the colored light and giving an impression that the mouth is opening;

not illuminating the mouth region with the ultraviolet light such that the at least one ultraviolet sensitive layer in the mouth region does not emit the colored light, thereby giving an impression that the mouth is closed; and generating audible speech that is synchronized with the simulated opening and closing of the mouth, thereby giving an impression that the mouth region is producing words.

* * * * *